US005298835A

United States Patent [19]

Muehlberger et al.

[11] Patent Number: 5,298,835

[45] Date of Patent: Mar. 29, 1994

[54] MODULAR SEGMENTED CATHODE PLASMA GENERATOR

[75] Inventors: Erich Muehlberger; Stephan E. Meuhlberger, both of San Clemente; Albert Sickinger, Irvine; Don E. Bailey, Moreno Valley, all of Calif.; Masamichi Koga, Kitakyushu, Japan; Koichi Takeda, Kawasaki, Japan; Tsuyoshi Shinoda, Kitakyushu, Japan

[73] Assignee: Electro-Plasma, Inc., Irvine, Calif.

[21] Appl. No.: 946,819

[22] Filed: Sep. 16, 1992

Related U.S. Application Data

[63] Continuation of Ser. No. 660,167, Feb. 25, 1991, abandoned, which is a continuation of Ser. No. 222,507, Jul. 21, 1988, abandoned.

[51] Int. Cl.[5] ..... H01J 7/24

[52] U.S. Cl. ..... 315/111.21; 315/111.91; 313/231.31

[58] Field of Search ..... 315/111.01, 111.21, 315/111.91; 313/231.01, 231.31, 306, 231.51

[56] References Cited

U.S. PATENT DOCUMENTS

| | | | |
|---|---|---|---|
| 2,964,678 | 12/1960 | Reid | 315/111.21 |
| 3,823,302 | 7/1974 | Muehlberger | 313/231.31 X |
| 3,839,618 | 10/1974 | Muehlberger | 219/121 P |
| 4,142,114 | 2/1979 | Green . | |
| 4,328,257 | 5/1982 | Muehlberger | 427/34 |
| 4,517,495 | 5/1985 | Piepmeier | 313/231.51 X |
| 4,638,217 | 1/1987 | Okubo et al. | 315/111.91 X |
| 4,780,591 | 10/1988 | Bernecki et al. | 313/231.51 X |

FOREIGN PATENT DOCUMENTS

| | | |
|---|---|---|
| 7556 | 3/1976 | Japan . |
| 230300 | 10/1986 | Japan . |

OTHER PUBLICATIONS

IEEE Journal of Solid≧State Circuits, vol. SC-22, No. 3, Jun. 1987, pp. 437-441, T, Furuyama et al., "A New On-Chip Voltage Converter for Submicrometer High--Density DRAM's".

IEEE Journal of Solid-State Circuits, vol. 25, No 1, Feb. 1990, pp. 48-54, W. Heimisch, et al., "A 3.8-NS 16K BiCMOS SRAM".

"Dual Operating-Voltgae Scheme for a Single 5-V 16-Mbit -DRAM" IEEE J of Solid State Circuit vol. 23, No. 5 pp. 1128-1132, Oct. 1988 M. Horiguchi et al.

*Primary Examiner*—Robert J. Pascal
*Assistant Examiner*—Michael Shingleton
*Attorney, Agent, or Firm*—Spensley Horn Jubas & Lubitz

[57] ABSTRACT

A supersonic plasma system in which a vacuum source creates a low static pressure environment within an enclosure containing a plasma gun and a workpiece has plural cathodes of sealed, modular construction in conjunction with a common anode, to provide higher levels of operating power and other advantages which flow from a segmented cathode gun configuration. Inert gas independently introduced into the plural cathodes undergoes swirling motion over the cathode tips. The anode is of modular construction for easy replacement in order to change the configuration of a nozzle, a plurality of arc chambers receiving the plural cathodes or a central mixing chamber between the nozzle and the arc chambers within the anode and coupled to a central powder feed. The powder feed includes a replaceable insert which includes at least one and preferably a plurality of powder feed ports into the various arc chambers. Alternatively, metal which has already been heated to a molten state can be fed directly into the central mixing chamber. The modular cathodes which are independently powered by separate D.C. power sources are also independently cooled by separate cooling water systems as is the common anode. The cooling systems are configured to produce swirling of the cooling water so that cooling action is maximized.

60 Claims, 14 Drawing Sheets

MODULAR SEGMENTED CATHODE PLASMA GENERATOR

This is a file wrapper continuation of Ser. No. 07/660,167 filed on Feb. 25, 1991, now abandoned, which application is a file wrapper continuation of Ser. No. 07/222,507 filed on Jul. 21, 1988, now abandoned.

BACKGROUND OF THE INVENTION

1. Field of the Invention

The present invention relates to plasma systems of the type in which a supersonic plasma stream is generated, and more particularly to plasma systems in which the plasma gun or generator has a plurality of electrodes of common polarity such as a segmented cathode in conjunction with an electrode of opposite polarity such as an anode.

2. History of the Prior Art

Supersonic plasma systems are well known as shown, for example, by U.S. Pat. No. 3,839,618 of Muehlberger, which patent issued Oct. 1, 1974 and is entitled "METHOD AND APPARATUS FOR EFFECTING HIGH-ENERGY DYNAMIC COATING OF SUBSTRATES". Such systems combine the introduction of an inert gas with an electrical potential difference at the electrodes to generate a plasma stream. The plasma stream establishes a transfer arc between the plasma generator or gun and a workpiece or target spaced a selected distance from the gun. The plasma stream may be used to heat the workpiece. The plasma stream may also be used to deposit a metallic coating on the workpiece such as where powdered metal is introduced into the plasma stream within the gun. The coupling of a vacuum or similar pumping source to an enclosure containing the plasma gun and the workpiece produces a low static pressure environment, resulting in a supersonic plasma stream. Such supersonic plasma systems have been found to be highly advantageous for many applications.

An improved supersonic plasma system is described in U.S. Pat. No. 4,328,257 of Muehlberger et al, which patent issued May 4, 1982 and is entitled "SYSTEM AND METHOD FOR PLASMA COATING". In the plasma system disclosed in the Muehlberger et al patent, a plasma gun is disposed within a closed chamber together with a workpiece. D.C. power supplies are coupled to the plasma gun and to the workpiece, and motion mechanisms are provided so that the gun and the workpiece may undergo various motions relative to one another. A powder feed mechanism is provided so that metallic powder can be injected into the plasma gun for spraying and deposition onto the workpiece. A lower end of the closed chamber downstream of the workpiece and the plasma gun is coupled through various filter and heat exchanger units to vacuum pumps for providing a low ambient pressure. The plasma gun contained at the upper end of the closed chamber is of conventional configuration and includes a single cathode and a single anode. As described in the patent a D.C. transfer arc power source coupled between the gun and the workpiece may be selectively switched in polarity to provide a reverse transfer arc where desired.

For certain applications of plasma systems, it has been found advantageous to provide a plasma generator or gun having plural or segmented electrodes of like polarity in conjunction with a common electrode of opposite polarity. Typically, the plural electrodes of like polarity are comprised of a segmented cathode which provides two or more separate cathodes in conjunction with a common anode. Examples of this are provided by Japanese Patent Publication No. 51(1976)-7556, of Mar. 9, 1976, and Japanese Patent Publication No. 61(1986)-230300, dated 1986. The Japanese patent publications describe plasma guns having segmented cathodes in which three separate cathodes are provided in conjunction with a common anode. Among other things, such a segmented electrode configuration enables metallic powder or other spray material to be introduced through a central injection port extending along the central axis of the plasma gun and the common electrode. This facilitates injection of such material when contrasted with the more conventional single cathode guns in which injection is made from the side of the gun, typically at an angle of 90° or more relative to the central axis of the gun.

Segmented cathode plasma systems such as the systems described in the Japanese patent publications noted above are designed to operate with an ambient pressure at or close to atmospheric pressure. As such, the systems do not enjoy the substantial advantages that flow from operation of a plasma system at low ambient pressure such as is provided through use of a vacuum pumping system. Heretofore, however, segmented cathode systems have not been designed for use in a vacuum or similar low ambient pressure environment, probably because of the complexities of designing such a system so that it will even operate let alone operate efficiently. The presence of the plural cathodes with their individual arc chambers in conjunction with the common anode presents a number of complicated problems. Such problems further make adaptability to different operating conditions extremely difficult. Still further complications are presented by the central powder delivery system which must be carefully integrated with other portions of the multi-electrode system.

Accordingly, it would be desirable to provide a multi-electrode plasma system such as a segmented cathode system which may be operated in a vacuum or similar low ambient pressure condition. It would furthermore be advantageous to provide such a system which is adaptable or adjustable to different operating conditions and parameters, including in particular operation under relatively high power conditions.

SUMMARY OF THE INVENTION

Plasma systems in accordance with the invention advantageously incorporate a multi-electrode configuration such as a segmented cathode configuration into a vacuum or similar low ambient pressure environment so as to provide a greatly improved plasma system utilizing the advantages of both segmented electrode operation and low ambient pressure operation. By understanding the important factors that influence the operation of such system and by incorporating that understanding into certain design changes and system adaptability, it is possible to scale up the system to power levels previously unattainable and to adapt the system for use in a variety of different applications.

The ability to operate at higher power levels brings with it the ability to spray greater volumes of materials within a given period of time, as well as the ability to provide greater heating or cleaning action at the workpiece. The greater adaptability of systems according to the invention enables the utilization of the multi-electrode configuration in the presence of low ambient pressure, for a variety of different operating environments and requirements therefor including the ability to spray a variety of different materials, introduced in different forms, using different power levels, different gases, different gas delivery rates, and other variable factors.

In plasma systems according to the invention which have a segmented cathode plasma generator or gun, the cathodes are of modular construction to facilitate the pressure sealing thereof as well as to provide easy installation in and removal thereof from the plasma gun. Inert plasma gas is separately supplied to each cathode assembly where it is caused to flow through a path which insures a desired gas velocity, volume and swirling action at the cathode tip within the arc chamber. The angle of incidence formed by the axis of elongation of the cathode assembly with the central axis of elongation of the gun and of the anode and which can be varied over a substantial angular range is chosen to provide successful operation under a variety of conditions. Angles of incidence of as little as 30° or as much as 105° may be used, although 45° is satisfactory for most operating conditions.

In plasma guns according to the invention, the common anode which is centrally located within the gun is also preferably of modular construction to facilitate easy installation in and removal from the gun. The anode provides and therefor determines the configuration of the arc chambers surrounding the tips of the various cathodes. The size and shape of the cavities within the anode defining the arc chambers combines with other factors such as gas pressure and gas spiral to determine the arc paths extending from the cathode tips. By providing the anode in a modular, easily replaceable configuration, the anode can easily be changed to provide different arc chamber configurations so that operation of the plasma system may be optimized for different operating conditions. The spiraling motion of the gas in the region of the cathode tips enhances arc stability, while the arc path controls the temperature within a central mixing chamber in the anode adjacent the various arc chambers.

The presence of the separate mixing chamber within the anode in accordance with a further feature of the invention defines a sonic region just above the supersonic nozzle chamber at the bottom of the anode. The presence of the separate mixing chamber allows for mixing of the gas and the material to be sprayed before acceleration thereof through the nozzle. The size and shape of the mixing chamber can be varied to adjust such things as plasma temperature and arc path. For example, the length of the mixing chamber can be varied to accommodate the different melting points of different powders, in order to prevent unwanted deposition of the powder on the anode walls. The mixing chamber configuration also plays a major role in determining the shape of the spray pattern. Again, the modular nature of and easy interchangeability of the anode facilitates the use of different anodes having different mixing chamber configurations in order to optimize operation of the plasma system for different operating conditions.

In accordance with the invention the plasma gun is provided with a powder insert holder to which is removably attached a powder insert. The removable powder insert which is disposed within the anode determines the flow configuration of powder being introduced into the mixing chamber. The interchangeability of powder inserts allows for the use of different insert configurations so that factors such as the material injection point within the mixing chamber can be varied for different applications. The feed port diameter and the material of the insert are also readily changed in this manner.

In accordance with the invention, the powder or other material to be sprayed with the plasma stream is preferably introduced through a plurality of different feed ports, each of which is associated with a different one of the cathodes. Each feed port terminates within a different one of the arc chambers. The multi-port injection configuration is preferably provided by a powder insert of appropriate design. Because the powder inserts are readily interchangeable, the multi-port configuration can easily be changed to accommodate different applications of the plasma system. The angle of each powder feed port relative to the central axis of the associated cathode assembly is important in optimizing system operation, as is the diameter of the port.

Cooling of the separate cathodes and the common anode is important in terms of proper operation of the plasma system, particularly at higher power levels. In accordance with the invention the individual cathode assemblies and the anode are separately supplied with cooling water and include separate cooling systems which are independent of one another. Each cathode assembly includes a cooling system configured such that the cooling water passing therethrough provides adequate cooling action for the cathode assembly. The cooling requirements for the common anode are particularly important, and such requirements are met by a unique cooling system configuration in which the cooling water is caused to periodically undergo swirling motion within and adjacent to various different parts of the anode to provide very effective cooling action. The powder insert holder which acts as a heat sink for heat in the powder insert and the central mixing chamber is cooled by action of an insert clamp mounted at the top of the anode assembly. Cooling water passing upwardly through apertures in the anode assembly is directed onto the powder insert holder in a swirling pattern by angled apertures in a lower portion of the insert clamp, then back out through apertures in an upper portion of the insert clamp.

In accordance with the invention material such as metal to be sprayed can be introduced into the plasma stream in a molten state. The direct central feeding of the material to be sprayed facilitates the introduction thereof in a molten state because of the ability to heat the material into a molten state just above and relatively close to the central mixing chamber within the anode assembly. Introduction of metal in a molten state is accomplished using a metal-feed assembly which has a hollow feed tube instead of a powder insert and powder insert holder. The hollow feed tube which extends through the top of the anode assembly to the central mixing chamber has an upper end terminating at a melt bowl just below a hollow supply tube. Pieces of metal placed within the hollow supply tube are heated to a molten state by one or more D.C. power supplies coupled to electrodes mounted in spaced-apart fashion along the metal melt-feed assembly and on the anode assembly. As the metal melts and flows to the bottom of the supply tube and then into the melt bowl, it is contained within the melt bowl by the gas pressure in the central mixing chamber. Such gas pressure is communicated to the melt bowl by the hollow feed tube. When it is desired to deliver the molten metal into the central mixing chamber, a source of pressurized gas is coupled to the upper end of the supply tube opposite the melt bowl. This overcomes the effects of gas pressure from the central mixing chamber allowing the molten metal to flow over the melt bowl, through the hollow feed tube, and into the central mixing chamber.

BRIEF DESCRIPTION OF THE DRAWINGS

A better understanding of the invention may be had by reference to the following specification in conjunction with the accompanying drawings, in which.

DETAILED DESCRIPTION OF THE INVENTION

Figure 1:
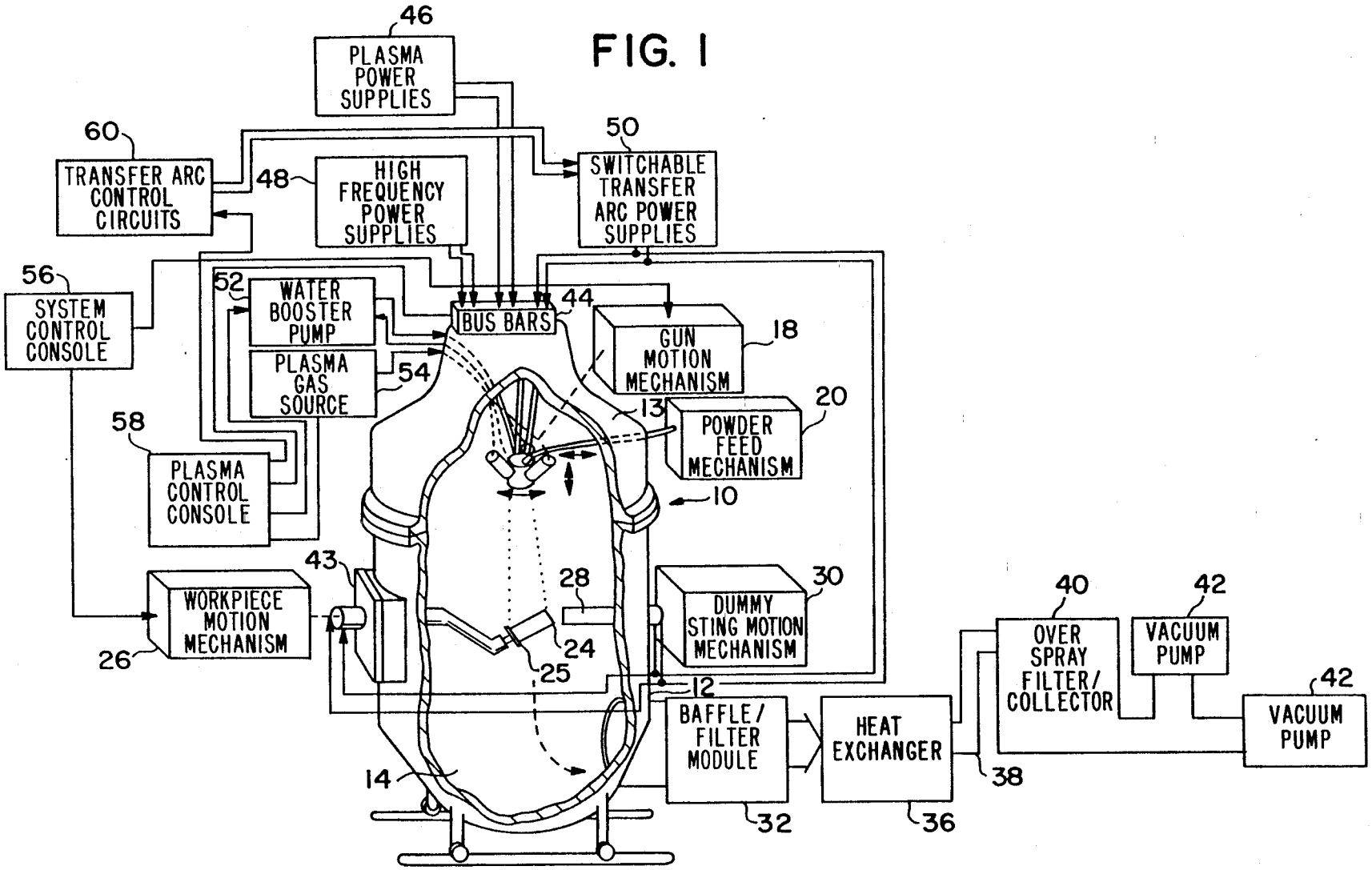
FIG. 1 is a combined block diagram and perspective view, partially broken away, of a plasma system in accordance with the invention.

FIG. 1 depicts a plasma system in accordance with the invention. The plasma system includes a plasma chamber 10 that provides a sealed vacuum-maintaining and pressure-resistant insulative enclosure. The chamber 10 is defined by a cylindrical principal body portion 12, and an upper lid portion 13 joined thereto. The body portion 12 of the plasma chamber 10 includes a bottom collector cone 14 that leads into and communicates with associated units for processing the exiting gases and particulates and maintaining the desired ambient pressure.

A downwardly directed plasma spray is established by a plasma gun 16 mounted within the interior of the chamber lid 13, the position of which gun 16 is controlled by a plasma gun motion mechanism 18. Both parts of the plasma chamber 10 are advantageously constructed as double walled, water cooled enclosures and the lid 13 is removable for access to the operative parts. The gun motion mechanism 18 supports and controls the plasma gun 16 through sealed bearings and couplings in the walls of the chamber lid 13. A powder feed mechanism 20 also coupled to the chamber lid 13 provides controlled feed of a heated powder into the plasma spray through flexible tubes that are coupled to the plasma gun 16.

The downwardly directed plasma stream impinges on a workpiece 24 supported on an internally cooled conductive workpiece holder 25 and positioned and moved while in operation via a shaft extending through the chamber body 12 to an exterior workpiece motion mechanism 26. Adjacent one end of the workpiece 24, but spaced apart therefrom, is a dummy workpiece or dummy sting 28, which is similarly internally cooled and coupled through a side wall of the chamber body 12 to a dummy sting motion mechanism 30. Both the workpiece holder 25 and the dummy sting 28 are adjustable as to insert position with respect to the central axis of the chamber 10 and electrically conductive so that they may be held at selected potential levels for transfer arc generation during various phases of operation.

Below the workpiece 24 and the dummy sting 28 positions, the collector cone 14 directs the overspray gaseous and particulate materials into a baffle/filter module 32 having a water cooled baffle section thereof for initially cooling the overspray and an in-line filter section thereof for extracting the majority of the entrained particle matter. Effluent passing through the baffle/filter module 32 is then directed through a heat-exchanger module 36, which may be another water cooled unit, into a vacuum manifold 38 containing an overspray filter/collector unit 40 which extracts substantially all particulate remaining in the flow. The vacuum manifold 38 communicates with vacuum pumps 42 having sufficient capacity to maintain a desired ambient pressure within the chamber 10. Typically, this ambient pressure is in the range from 0.6 atmospheres down to 0.001 atmospheres. The baffle/filter module 32 and the heat exchanger module 36, as well as the overspray filter/collector 40 are preferably double walled water cooled systems, and any of the types well known and widely used in plasma systems may be employed. The entire system may be mounted on rollers and movable along rails for ease of handling and servicing of different parts of the system. Conventional viewing windows, water cooled access doors and insulated feed through plates for electrical connection have not been shown or discussed in detail, for simplicity of illustration. The workpiece support and motion control system is advantageously mounted in a hinged front access door 43 in the chamber body 12.

Electrical energy is supplied into the operative portions of the system via fixed bus bars 44 mounted on the top of the chamber lid 13. Flexible water cooled cables couple external plasma power supplies 46 and high frequency power supplies 48 via the bus bars 44 into the plasma gun 16 for generation of the plasma stream. The plasma power supplies 46 provide the requisite electrical potential differences between the electrodes of the plasma gun 16 and between the plasma gun 16 and the workpiece 24. The high frequency power supplies 48 are used to initiate the plasma transfer arc by superimposing a high frequency voltage discharge on the D.C. supply from the plasma power supplies 46 in known fashion. A switchable transfer arc power supply 50 is coupled via the bus bars 44 to the plasma gun 16, the workpiece holder 25 and the dummy sting 28. As described in the previously referred to U.S. Pat. No. 4,328,257 of Muehlberger et al, the transfer arc power supply 50 may be employed to provide a reverse transfer plasma arc between the plasma gun 16 and the workpiece 24 in advantageous fashion.

Operation of the plasma gun 16 entails usage of a water booster pump 52 to provide an adequate flow of cooling water through the interior of the plasma gun 16, as described in detail hereafter. A plasma gas source 54 provides a suitable ionizing gas for generation of the plasma stream. The plasma gas here employed is either argon alone or argon seeded with helium or hydrogen, although other gases may be employed as is well known to those skilled in the art.

Control of the sequencing of the system of FIG. 1, and the velocity and amplitude of motion of the various motion mechanisms, is governed by a system control console 56. The plasma gun 16 is separately operated under control of a plasma control console 58. In as much as the functions performed by these consoles and the circuits included therein are well understood, they have not been shown or described in detail. Transfer arc control circuits 60 control switching of the transfer arc polarity.

Except for the plasma gun 16 which employs a segmented cathode configuration, the remainder of FIG. 1 is essentially identical to the plasma system described in previously referred to U.S. Pat. No. 4,328,257 of Muehlberger et al, and reference thereto is made to the extent that further explanation of one or more portions of the plasma system may be needed.

Figure 2:
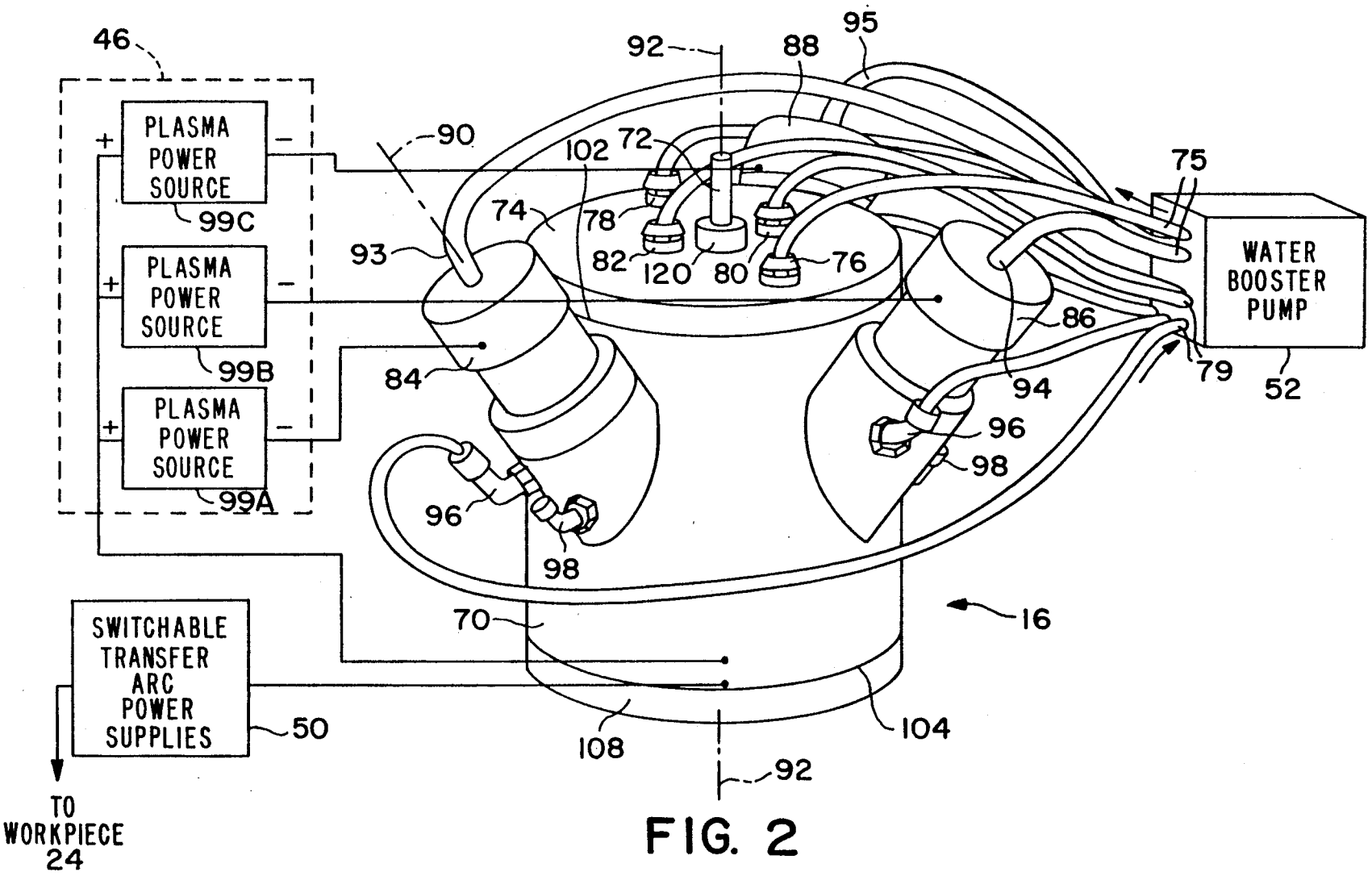
FIG. 2 is a perspective view of the plasma gun of the plasma system of FIG. 1 together with certain other portions of the plasma system.

FIG. 2 shows the plasma gun 16 of FIG. 1. The plasma gun 16 includes a generally cylindrical gun body 70 which houses an anode and a cooling system therefor together with certain powder delivery apparatus as described hereafter. Powder or other material to be sprayed is advanced into the plasma gun 16 via a powder tube 72 extending through an anode connection plate 74 at the top of the body 70.

The water booster pump 52 is coupled to the body 70 of the plasma gun 16 to provide cooling water to an anode cooling system within the body 70. The water booster pump 52 which is coupled to the plasma gun 16 by two of a plurality of cooling water supply conduits 75 emanating from the upper portion of the water booster pump 52 provides a supply of cooling water to the body 70 via fittings 76 and 78 mounted on the anode connection plate 74. Water which is passed through the cooling system for the anode is returned to the water booster pump 52 via two of a plurality of cooling water return conduits 79 emanating from the lower portion of the water booster pump 52. The two cooling water return conduits are coupled to fittings 80 and 82 mounted on the anode connection plate 74. The anode and the cooling system therefor are described in detail hereafter in connection with FIG. 3.

Figure 4:
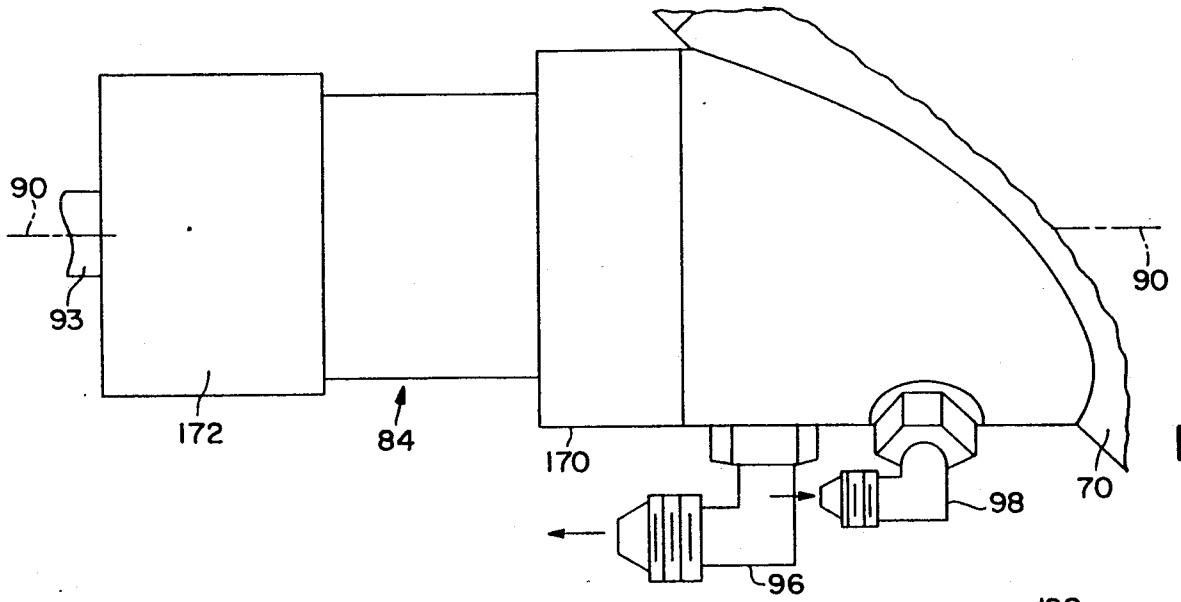
FIG. 4 is a side view of one of the modular cathode assemblies of the plasma gun of FIG. 2.
Figure 5:
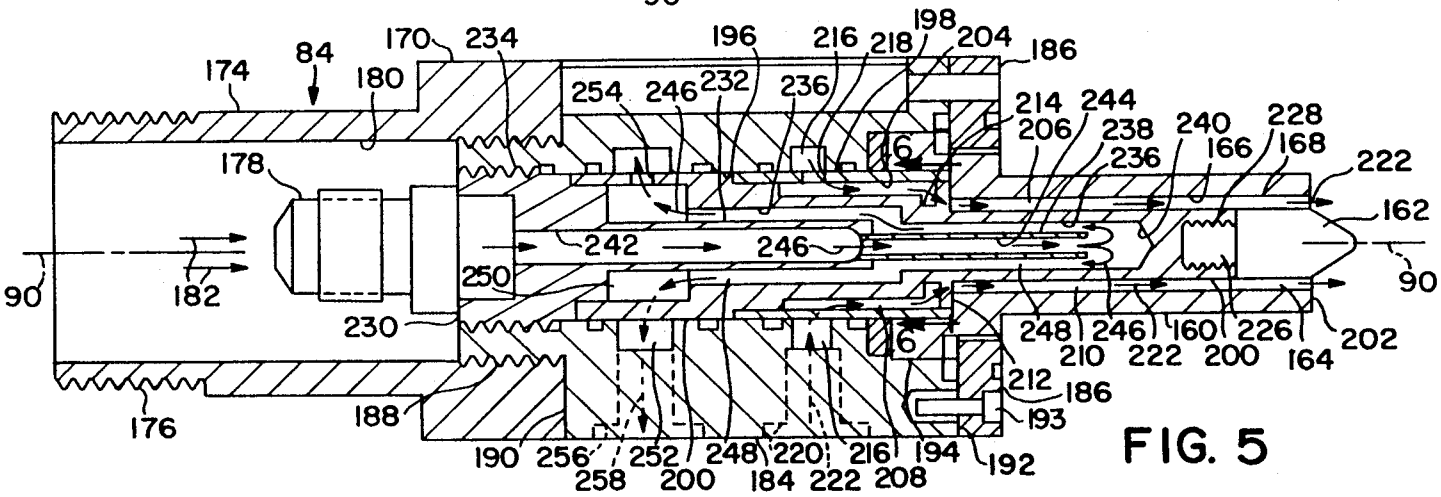
FIG. 5 is a sectional view of the modular cathode assembly of FIG. 4.

The plasma gun 16 is provided with three different cathode assemblies 84, 86 and 88 which are described in detail hereafter in connection with FIGS. 4 and 5. Each of the cathode assemblies 84, 86 and 88 is of elongated, generally cylindrical configuration and extends into the body 70 through an outer wall such that an axis of elongation 90 of the cathode assembly intersects and forms an angle of approximately 45° with a central axis 92 of the body 70. The cathode assemblies 84, 86 and 88 are generally equally spaced around the body 70 so as to be displaced from one another by approximately 120° relative to the central axis 92.

The cathode assembly 84 receives cooling water from the water booster pump 52 of FIG. 1 via a separate conduit 93 comprising one of the cooling water supply conduits 75. In similar fashion the cathode assemblies 86 and 88 are supplied by separate conduits 94 and 95 respectively. Cooling water which is supplied to each cathode assembly 84, 86 and 88 via the conduits 93, 94 and 95 circulates through the cathode assembly to provide internal cooling as described hereafter in connection with FIG. 5 before exiting the cathode assembly via a fitting 96 at the side thereof. Each of the fittings 96 is coupled to the water booster pump 52 via a different one of the cooling water return conduits 79. A further fitting 98 on the side of each cathode assembly 84, 86 and 88 is coupled via a conduit (not shown) to the plasma gas source 54 of FIG. 1 for providing a supply of plasma gas to the cathode assembly.

The plasma gun 16 is shown and described in FIG. 2 and hereafter as being comprised of the three cathode assemblies 84, 86 and 88 for purposes of illustration only. It will be understood by those skilled in the art that numbers other than three of the electrodes of common polarity may be employed in accordance with the principles of the invention. Also, as discussed hereafter, the cathode assemblies 84, 86 and 88 can be mounted so that their axes of elongation 90 form angles other than 45° with the central axis 92 of the body 70.

As shown in FIG. 2 the plasma supplies 46 of FIG. 1 comprise three different plasma power sources 99A, 99B and 99C respectively coupled to the cathode assemblies 84, 86 and 88. Each of the plasma power sources 99A, 99B and 99C is comprised of a D.C. power source having the positive terminal thereof coupled to the anode within the gun body 70 and the negative terminal thereof coupled to the associated one of the cathode assemblies 84, 86 and 88. The plasma power sources 99A, 99B and 99C are separately adjustable so that the plasma power to the cathode assemblies 84, 86 and 88 is independently variable. As shown in FIG. 2 the switchable transfer arc power supplies 50 are coupled between the anode within the body 70 and the workpiece 24. The high frequency power supplies 48 which are not shown in FIG. 2 are preferably comprised of a different high frequency power supply for and coupled to each of the cathode assemblies 84, 86 and 88 to initiate the plasma transfer arc by superimposing high frequency voltage discharges on the plasma power sources 99A, 99B and 99C.

Figure 3:
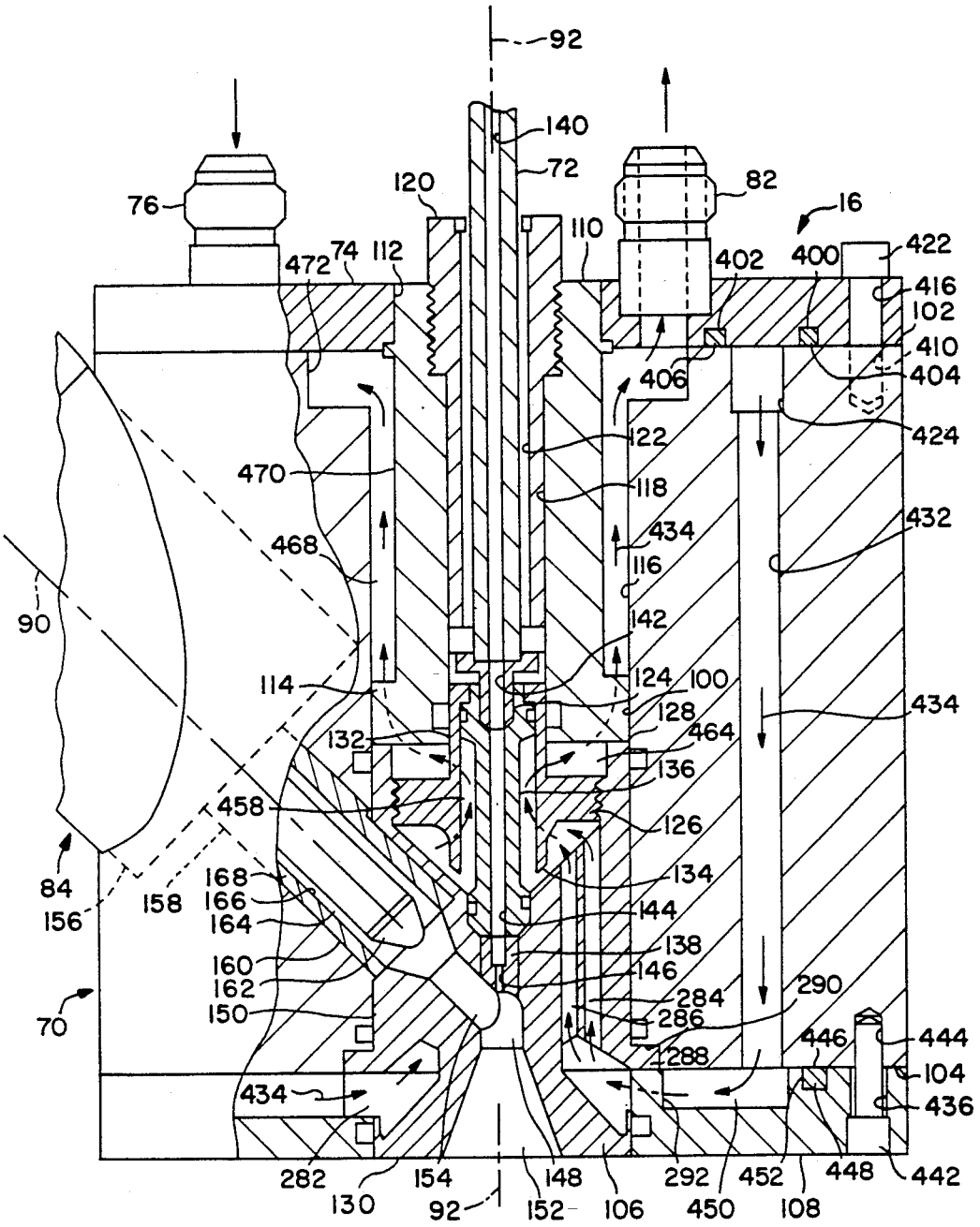
FIG. 3 is a sectional view of a portion of the plasma gun of FIG. 2 showing the modular anode of the plasma gun together with powder delivery apparatus, the anode cooling system and a portion of one of three modular cathode assemblies of the plasma gun.

FIG. 3 is a partial sectional view of the body 70 and an adjoining portion of the cathode assembly 84 of the plasma gun 16. The cathode assemblies 86 and 88 are omitted from FIG. 3 for simplicity of illustration.

As shown in FIG. 3 the body 70 is of generally cylindrical configuration and has a cylindrical bore 100 extending through the center thereof along the central axis 92 between a top 102 of the body 70 and an opposite bottom 104 of the body 70. The central bore 100 has an anode assembly 106 mounted therein at a lower portion thereof. The anode assembly 106 is held in place within the lower end of the bore 100 by an anode retainer 108 coupled to the bottom 104 of the body 70. The anode retainer 108 is shown and described in detail hereafter in connection with FIG. 28.

An anode connector plug 110 comprises a part of powder delivery apparatus mounted within an upper portion of the cylindrical bore 100. The anode connector plug 110 extends upwardly from the top of the anode assembly 106 and is received within a central aperture 112 in the anode connection plate 74 at the top 102 of the body 70. A lower end of the anode connector plug 110 terminates in a flange 114 extending into a wall 116 of the cylindrical bore 100. The anode connector plug 110 has a generally cylindrical bore 118 therein in which is mounted a feed tube retainer 120. The feed tube retainer 120, which has threads at an upper portion thereof secured within mating threads in an upper end of the anode connector plug 110 to secure the feed tube retainer 120 therein, has a cylindrical bore 122 therein in which the powder tube 72 is mounted.

As previously noted the powder tube 72 carries powdered metal or other material to be introduced into the plasma stream from the powder feed mechanism 20 shown in FIG. 1. The powdered metal or other material is fed under pressure into the plasma gun 16 through the powder tube 72. As shown in FIG. 3 the powder tube 72 terminates at a powder tube spout 124 attached thereto so as to be disposed within the cylindrical bore 118 of the anode connector plug 110. An insert clamp 126 which is mounted within a top portion 128 of the anode assembly 106 opposite a base 130 of the anode assembly 106 and which is shown and described in detail hereafter in connection with FIGS. 29–31 has a hollow, generally cylindrical upper portion 132 thereof seated within a lower portion of the cylindrical bore 118 of the anode connector plug 110 adjacent the powder tube spout 124. The insert clamp 126 has an opposite lower portion 134 of hollow, generally cylindrical configuration disposed within the top portion 128 of the anode assembly 106.

Figure 15:
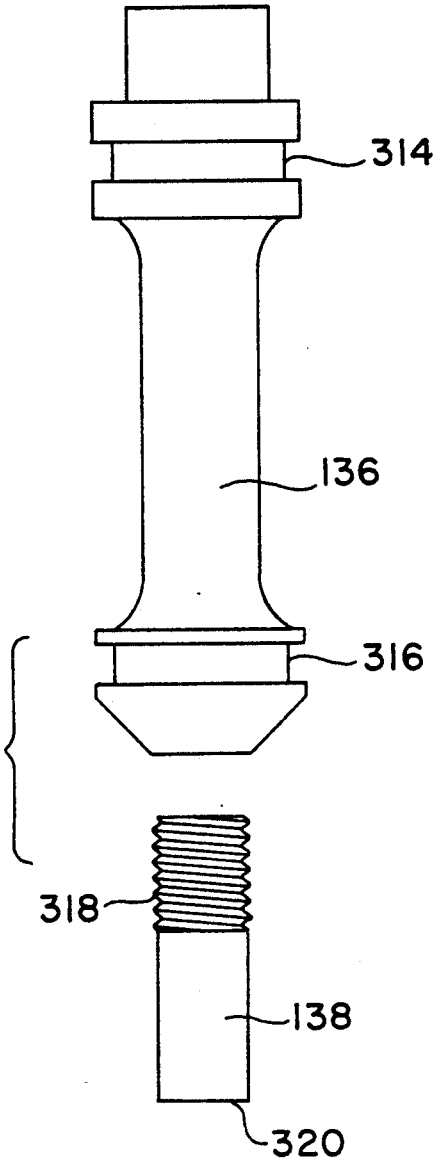
FIG. 15 is a plan view of the powder insert holder of the plasma gun of FIGS. 2 and 3 together with a removable powder insert for mounting within the modular anode.

An elongated powder insert holder 136 which is shown and described in detail hereafter in connection with FIG. 15 has an upper portion 132 of the insert clamp 126 so as to receive the powder tube spout 124 therein. An opposite lower portion of the powder insert holder 136 extends into the anode assembly 106 and has a cylindrical powder insert 138 coupled thereto. The powder tube 72 has a bore 140 therein which communicates with and delivers powder to a central bore 142 within the powder tube spout 124. The bore 142 in turn communicates with and delivers the powder to a central bore 144 of the powder insert holder 136. As described in detail hereafter, the central bore 144 of the powder insert holder 136 delivers the powder through one or more powder feed ports within the powder insert 138. The powder insert 138 shown in FIG. 3 contains a single powder feed port 146 which terminates at a central mixing chamber 148 within an integrally formed body 150 of the anode assembly 106.

The central mixing chamber 148 within the body 150 of the anode assembly 106 communicates with the outside of the plasma gun 16 at the base 130 of the anode assembly 106 via a central nozzle chamber 152. The central mixing chamber 148 also communicates with a plurality of arc chambers 154 formed within the body 150 of the anode assembly 106 and each being associated with a different one of the cathode assemblies 84, 86 and 88. One of the arc chambers 154 is shown in FIG. 3 in conjunction with the cathode assembly 84.

The body 70 of the plasma gun 16 is provided with a generally cylindrical aperture 156 therein for receiving the cathode assembly 84. The cylindrical aperture 156 is represented in dotted outline form in FIG. 3. The cylindrical aperture 156 terminates at a generally cylindrical aperture 158 which extends into the body 70 from the aperture 156 and which is shown partially in dotted outline and partially in solid outline in FIG. 3. The aperture 158 receives a chamber insulator 160 forming a part of the cathode assembly 84 together with a cathode tip 162 mounted within the chamber insulator 160. The chamber insulator 160 terminates at and the cathode tip 162 extends into the arc chamber 154. The cathode assemblies 86 and 88 which are not shown in FIG. 3 are mounted in the plasma gun 16 in similar fashion.

As described hereafter the cathode assembly 84 is operative to cause the flow of an inert gas in a swirling pattern along a gas passage 164 formed by an annular space between the cathode tip 162 and an inner wall 166 of a generally cylindrical bore 168 of the chamber insulator 160. The plasma power source 99A shown in FIG. 2 is coupled between the cathode tip 162 of the cathode assembly 84 and the body 150 of the anode assembly 106 to provide a desired electrical potential difference therebetween. This combines with the flow of inert gas over the cathode tip 162 to form a plasma arc within the arc chamber 154 and a resulting plasma stream which flows from the central mixing chamber 148 through the central nozzle chamber 152 and out of the plasma gun 16. The velocity of the inert gas within the arc chamber 154 is in the subsonic region. As the gas enters the central mixing chamber 148, the gas mixes with powder introduced through the powder insert 138. The mixing chamber 148 defines a sonic region in terms of the velocity of the plasma stream therein. The mixture of gas and powder then accelerates within the nozzle chamber 152 which defines a supersonic region for the plasma stream. The plasma stream exiting the nozzle chamber 152 continues on to the workpiece 24 and then out of the bottom collector cone 14 of the plasma chamber 10 at supersonic speeds due to the action of the vacuum pumps 42 shown in FIG. 1. A transfer arc is produced between the anode assembly 106 and the workpiece 24 by the switchable transfer arc power supplies 50 shown in FIGS. 1 and 2.

While not shown in FIG. 3, the cathode assemblies 86 and 88 function in a similar manner in connection with their respective arc chambers 154 within the body 150 of the anode assembly 106 to produce plasma arcs which contribute to the plasma stream flowing from the mixing chamber 148 through the nozzle chamber 152 and out of the plasma gun 16.

FIG. 3 shows in both solid and dotted outline form the portion of the cathode assembly 84 that resides within the body 70 of the plasma gun 16. FIG. 4 in turn shows the portion of the cathode assembly 84 extending outside of the body 70, while FIG. 5 is a sectional view of the entire cathode assembly 84.

As seen in FIG. 4, the cathode assembly 84 is of modular construction, being comprised generally of an elongated, generally cylindrical body 170 having as its axis of elongation the axis of elongation 90 of the cathode assembly 84. The modular nature of the cathode assembly 84 facilitates the pressure sealing of the interior thereof as well as making the cathode assembly 84 removable as an integral unit from the body 70 of the plasma gun 16. The cathode assembly 84 is removably mounted within the body 70 so that the body 170 of the cathode assembly 84 resides within the mating cylindrical aperture 156 shown in dotted outline in FIG. 3. This seats the chamber insulator 160 of the cathode assembly 84 within the smaller cylindrical aperture 158 in the body 70 so that the cathode tip 162 is disposed in the proper position within the arc chamber 154.

As shown in FIG. 4 the portion of the body 170 of the cathode assembly 84 extending outside of the body 70 of the plasma gun 16 includes the water fitting 96 and the gas fitting 98. The conduit 93 supplying cooling water from the water booster pump 52 shown in FIGS. 1 and 2 extends through an insulator nut 172 secured to an outer end of the body 170. Cooling water which enters the cathode assembly 84 via the conduit 93 and which passes through the cooling system for the cathode 84 exits from the cathode assembly 84 via the water fitting 96 which, as noted in connection with FIG. 2, is coupled via one of the cooling water return conduits 79 to the water booster pump 52. Also, as previously noted, inert gas from the plasma gas source 54 shown in FIG. 1 is applied to the gas fitting 98.

In the sectional view of the cathode assembly 84 shown in FIG. 5, the insulator nut 172 which is screwed onto the end of a cable insulator 174 via threads 176 at the end of the cable insulator 174 is not shown. Also, the conduit 93 which is coupled to a fitting 178 located in a generally cylindrical bore 180 of the cable insulator 174 is not shown. The cooling water from the water booster pump 52 is provided to the fitting 178 by the conduit 93, and such cooling water is represented by arrows 182 in FIG. 5.

The cable insulator 174 forms a portion of the body 170 of the cathode assembly 84 together with the chamber insulator 160, a generally cylindrical cathode insulator connector 184 and a generally ring-shaped insulator retainer 186. The cathode insulator connector 184 has a set of threads 188 to which the cable insulator 174 is secured adjacent a first end 190 of the cathode insulator connector. The ring-shaped insulator retainer 186 is secured to an opposite second end 192 of the cathode insulator connector 184 such as by bolts 193 to secure the chamber insulator 160 within an annular recess 194 in the second end 192 of the cathode insulator connector 184.

The cathode insulator connector 184 has a generally cylindrical bore 196 therein in which is seated a hollow, generally cylindrical gas conductor tube 198. The gas conductor tube 198 extends along a portion of the cylindrical bore 196 from the chamber insulator 160. The remaining portion of the cylindrical bore 196 is occupied by a portion of a cathode connector tube 200. The cathode connector tube 200 which is of elongated, generally cylindrical, stepped configuration has an axis of elongation coincident with the axis of elongation 90 of the cathode assembly 84. The cathode connector tube 200 extends from a region adjacent the first end 190 of the cathode insulator connector 184 all the way to a region adjacent an outer end 202 of the chamber insulator 160 to mount the cathode tube 162 therein. The cathode connector tube 200 is stepped down in outer diameter along a portion of the gas conductor tube 198 and again along a substantial portion of the chamber insulator 160 to form an annular space within an inner wall 204 of the gas conductor tube 198 and the inner wall 166 of the chamber insulator 160. Such annular space forms a gas passage 206 having a first portion 208 thereof of generally uniform diameter extending along a major portion of the gas conductor tube 198 and a second portion 210 thereof of generally uniform diameter smaller than the uniform diameter of the first portion 208 extending along most of the length of the chamber insulator 160. The cathode connector tube 200 has an annular collar 212 thereon extending into the gas passage 206 adjacent a juncture 214 of the first and second portions 208 and 210 of the gas passage 206.

The cathode insulator connector 184 has an annular recess in the cylindrical bore 196 thereof which forms an annular gas inlet chamber 216. The annular gas inlet chamber 216 surrounds a portion of the outside of the gas conductor tube 198 and communicates with the first portion 208 of the gas passage 206 on the opposite side of the gas conductor tube 198 via a plurality of apertures 218 in the gas conductor tube 198. The apertures 218 are spaced around the circumference of the gas conductor tube 198 at the annular gas inlet chamber 216, and one of the apertures 218 is shown in FIG. 5.

The gas fitting 98 which is mounted on the outside of the body 170 of the cathode assembly 84 as shown in FIG. 4 is used to feed a supply of pressurized, substantially inert gas to the first portion 208 of the gas passage 206 via the annular gas inlet chamber 216 and the apertures 218 in the gas conductor tube 198. The gas fitting 98 which is not shown in FIG. 5 is coupled to the annular gas inlet chamber 216 by a passage 220 in the cathode insulator connector 184. The passage 220 is shown in dotted outline in FIG. 5, and the flow of gas therethrough is represented by a dotted arrow 222. The gas which flows through the passage 220 under pressure fills the annular gas inlet chamber 216 and from there flows through the apertures 218 into the first portion 208 of the gas passage 206. The gas within the first portion 208 flows to the annular collar 212 of the cathode connector tube 200 where the gas is forced into a spiral flow pattern in the second portion 210 of the gas passage 206 by an arrangement of apertures in the annular collar 212.

Figure 6:
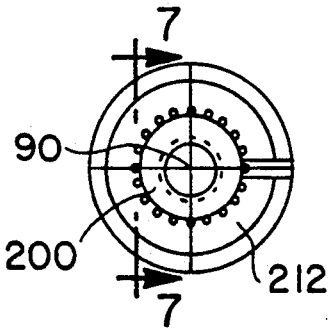
FIG. 6 is a sectional view of the cathode connector tube within the cathode assembly of FIGS. 4 and 5 taken along the line 6—6 of FIG. 5 and showing an annular collar thereof for producing swirling motion of inert gas over the cathode tip.
Figure 7:
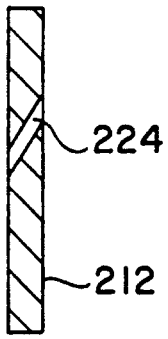
FIG. 7 is a sectional view of the cathode connector tube of FIG. 6 taken along the line 7—7 thereof and showing one of the obliquely oriented apertures therein used to produce gas swirl.

The annular collar 212 is shown in detail in FIGS. 6 and 7, with FIG. 7 being a sectional view of a portion of FIG. 6. As shown in FIG. 6, the annular collar 212 is provided with a plurality of apertures 224 therein disposed in a spaced-apart circumferential pattern just outside of the cathode connector tube 200. It was previously noted that the cathode connector tube 200 has an axis of elongation which is coincident with the axis of elongation 90 of the cathode assembly 84. The apertures 224 are disposed obliquely relative to the axis of elongation 90, and this is brought out by FIG. 7 which shows one of the apertures 224 in section. This oblique orientation of the apertures 224 relative to the axis of elongation 90 forces the gas into a spiraling pattern along the second portion 210 of the gas passage 206 as the gas passes through the apertures 224 within the annular collar 212.

The swirling pattern of the inert gas continues as the gas passes over the cathode tip 162 and into the arc chamber 154 in the anode assembly 106. Such spiraling motion enhances the stability of the resulting plasma arc that forms within the arc chamber 154.

As shown in FIG. 5, the cathode tip 162 is mounted on the end of the cathode connector tube 200 adjacent the outer end 202 of the chamber insulator 160. The cathode tip 162, which may be constructed of conventional materials such as tungsten or copper, may be attached to the end of the cathode connector tube 200 by any appropriate technique such as gold soldering. However, the cathode tip 162 is preferably attached by a threaded arrangement to facilitate removal and replacement of the cathode 162. The cathode tip 162 has a threaded end 226 thereof which is received within a mating threaded aperture 228 in the end of the cathode connector tube 200.

As previously noted a supply of cooling water is provided to the cathode assembly 84 by the conduit 93 from the water booster pump 52. The conduit 93 extends through the insulator nut 172 at the end of the cable insulator 174 and into the cylindrical bore 180 of the cable insulator 174 where the conduit 93 couples to the fitting 178. The fitting 178 is mounted on an end 230 of an inner connector tube 232 of elongated, generally cylindrical configuration. The inner connector tube 232 which is mounted on a portion of the cathode insulator connector 184 opposite the cable insulator 174 and adjacent the first end 190 of the cathode insulator connector 184 by threads 234 thereon extends into an elongated hollow interior 236 of the cathode connector tube 200. The inner connector tube 232 which forms an elongated cooling tube member includes a water tube 238 at a forward end thereof which terminates just short of an end 240 of the hollow interior 236 of the cathode connector tube 200 adjacent the cathode tip 162.

Cooling water introduced into the fitting 178 flows along a hollow interior 242 of the inner connector tube 232 and then through a hollow interior 244 of the water tube 238. The water flow is represented by a series of arrows 246. The water flows out the open end of the water tube 238 at the end 240 of the hollow interior 236, at which point the water flow reverses in direction and enters an annular space 248 formed between the elongated hollow interior 236 of the cathode connector tube 200 and the outsides of the water tube 238 and the inner connector tube 232. The annular space 248 leads into an annular chamber 250 which encircles the inside of the cathode connector tube 200. An annular recess in the cathode insulator connector 184 on the outside of the cathode connector tube 200 opposite the annular chamber 250 forms an annular cooling water outlet chamber 252.

The annular chamber 250 communicates with the annular cooling water outlet chamber 252 via a plurality of apertures 254 spaced around the cathode connector tube 200. One of the apertures 254 is shown in FIG. 5. Cooling water in the annular space 248 which enters the annular chamber 250 enters the annular cooling water outlet chamber 252 by way of the apertures 254 in the cathode connector tube 200. The annular cooling water outlet chamber 252 is coupled to the fluid coupling 96 shown in FIG. 4 but not in FIG. 5 by a passage 256 which is shown in dotted outline in FIG. 5. The flow of cooling water through the passage 256 is represented by a dotted arrow 258.

The dotted representations of the gas passage 220 and the water passage 256 in the cathode insulator connector 184 are shown as being generally parallel to one another and in the same circumferential position in FIG. 5 for convenience of illustration only. In actuality, the passages 220 and 256 are offset from one another around the circumference of the cathode insulator connector 184 as will be appreciated by the offset positioning of the water fitting 96 and the gas fitting 98 as shown in FIGS. 2 and 4.

It will be appreciated from an examination of FIG. 5 that the cathode cooling system provided by the fitting 178, the inner connector tube 232, the water tube 238, the annular chambers 250 and 252 and the passage 256 provide cooling action along a substantial portion of the region of gas flow within the cathode assembly 84. Such cooling system provides more than adequate cooling in the face of the delivery of substantial volumes of inert gas under relatively high pressure and including the substantial friction which occurs as the swirling pattern of the gas is created at the annular collar 212.

Figure 8:
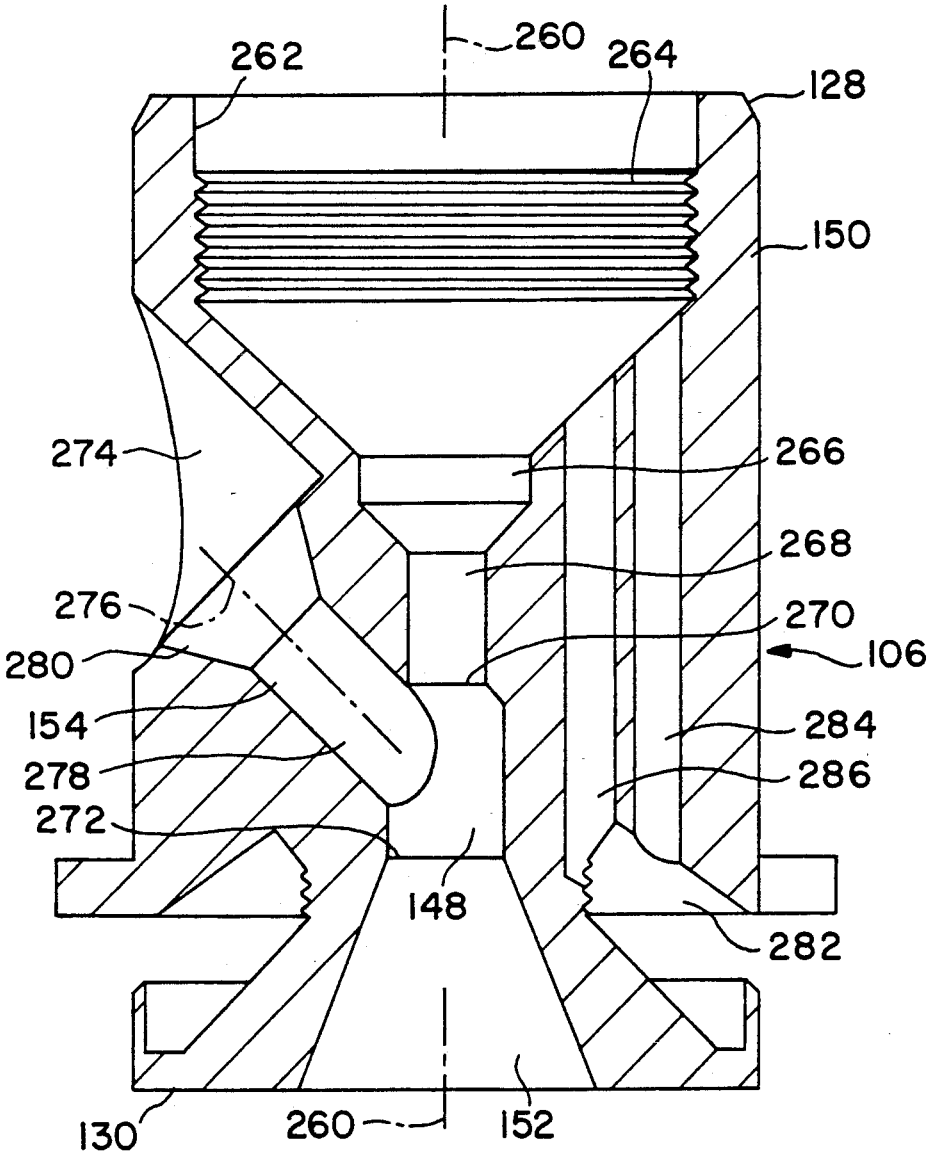
FIG. 8 is a sectional view of the integrally formed body of the modular anode of FIG. 3.

As previously noted in connection with the discussion of FIG. 3, the modular anode assembly 106 is comprised principally of the integrally formed body 150. FIG. 8 is a sectional view of the body 150. As shown therein the body 150 has a central axis 260. When the anode assembly 106 is installed within the lower portion of the cylindrical bore 100 of the body 70 of the plasma gun 16 and held in place therein by the anode retainer 108, the central axis 260 is generally coincident with the central axis 92 of the body 70 of the plasma gun 16.

The top portion 128 of the anode assembly 106 has a generally cylindrical bore 262 therein having a threaded portion 264 thereof. The threaded portion 264 receives the insert clamp 126 shown in FIG. 3 and in FIGS. 29-31 which are described hereafter. Below the threaded portion 264, the cylindrical bore 262 tapers to a circular chamber 266. The circular chamber 266 is configured to receive a lower end of the powder insert holder 136 shown in FIG. 3 and in FIG. 15. A generally cylindrical aperture 268 extends downwardly from the circular chamber 266 to a first end 270 of the central mixing chamber 148 and is configured to receive the powder insert 138 shown in FIGS. 3 and 15. An opposite second end 272 of the central mixing chamber 148 denotes the juncture between the central mixing chamber 148 and the central nozzle chamber 152.

As previously described the anode assembly 106 has three of the arc chambers 154 therein which are spaced equally about the central axis 92 of the body 70 and thus the central axis 260 of the anode assembly 106. Only one of the arc chambers 154 is shown in FIG. 8. The arc chamber 154 extends into the body 150 from the bottom of an opening 274 in the side of the body 150. The opening 274 receives the outer end of the chamber insulator 160 when the cathode assembly 84 is mounted in the body 70 of the plasma gun 16. This places the cathode tip 162 of the cathode assembly 84 in an operative position within the arc chamber 154.

The arc chamber 154 extends from the bottom of the opening 274 of the housing 150 to the central mixing chamber 148 along a central axis 276. The arc chamber 154 is comprised of a generally cylindrical portion 278 which communicates with the central mixing chamber 148 adjacent the first end 270 thereof. The arc chamber 154 also has a portion 280 thereof which is of partial conical configuration and which diverges in the direction from the cylindrical portion 278 to the bottom of the opening 274.

The body 150 of the anode assembly 106 has an annular cavity 282 therein which surrounds the body 150 adjacent the base 130. As described hereafter, cooling water within the anode cooling system is forced into a swirling pattern within the annular cavity 282 before passing upwardly through a plurality of apertures in the body 150 to the cylindrical bore 262. Two such apertures 284 and 286 are shown in FIG. 8.

Figure 10:
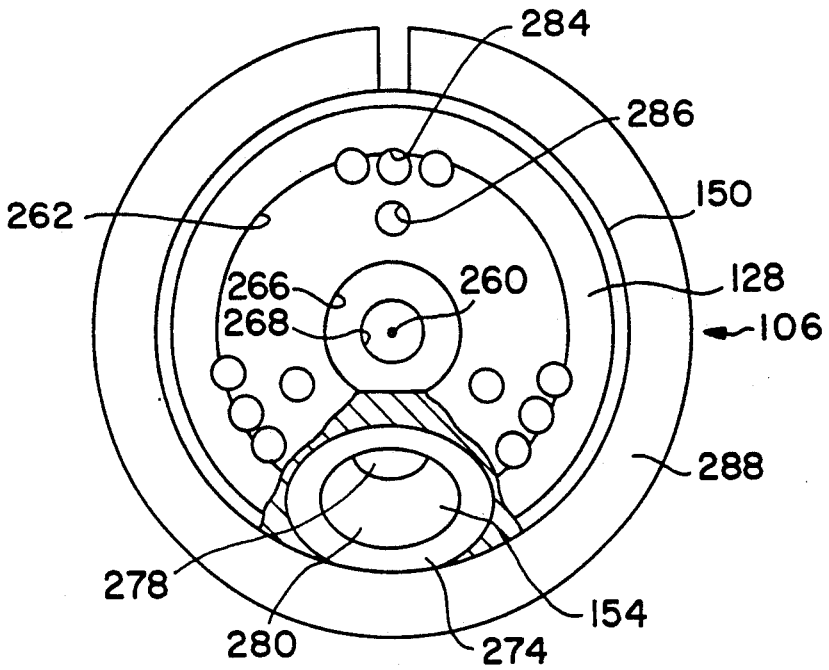
FIG. 10 is a top view, partially broken away, of the modular anode of FIG. 3.
Figure 9:
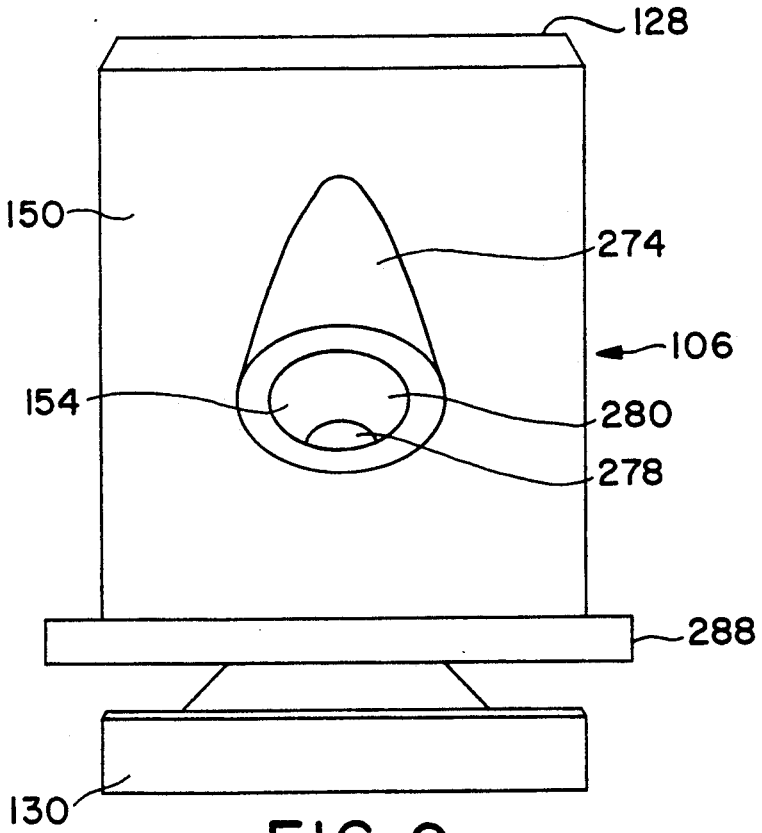
FIG. 9 is a front view of the modular anode of FIG. 3.

FIG. 9 is a front view of the anode assembly 106 which is taken from the left side of the sectional view of FIG. 8 so that the opening 274 appears at the center thereof. FIG. 10 is a top view of the anode assembly 106 with a portion of the body 150 being broken away to reveal the opening 274 and the associated arc chamber 154. The anode assembly 106 has two additional openings of like configuration to the opening 274 for receiving the cathode assemblies 86 and 88. The two additional openings do not appear in the views of FIGS. 9 and 10.

As shown in FIGS. 9 and 10, a lower portion of the body 150 is provided with an annular rim 288. The rim 288 which protrudes outwardly from the remainder of the body 150 seats within an annular recess 290 at the lower end of the cylindrical bore 100 in the body 70 when the anode assembly 106 is mounted within the body 70. The rim 288 seats within the recess 290 to properly position the anode assembly 106 within the body 70 and prevent upward movement of the anode assembly 106 within the bore 100. With the anode retainer 108 secured to the bottom 104 of the body 70, a circular flange 292 within the anode retainer 108 and which is shown in FIG. 3 abuts a lower surface of the rim 288 to hold the rim 288 within the recess 290 and thereby secure the anode assembly 106 within the body 70.

FIG. 10 shows the apertures 284 and 286. The apertures 284 and 286 are included within one of three different aperture groups of like configuration disposed generally equidistantly about the central axis 260. The aperture 286 is located along with two other apertures along an inner radius relative to the central axis 260. The aperture 284 is one of three apertures located along with two other groups of three apertures along an outer radius relative to the central axis 260. As mentioned previously, and as described hereafter, the groups of apertures including the apertures 284 and 286 are employed to pass cooling water upwardly therethrough to provide for cooling of the anode assembly 106.

Figure 11:
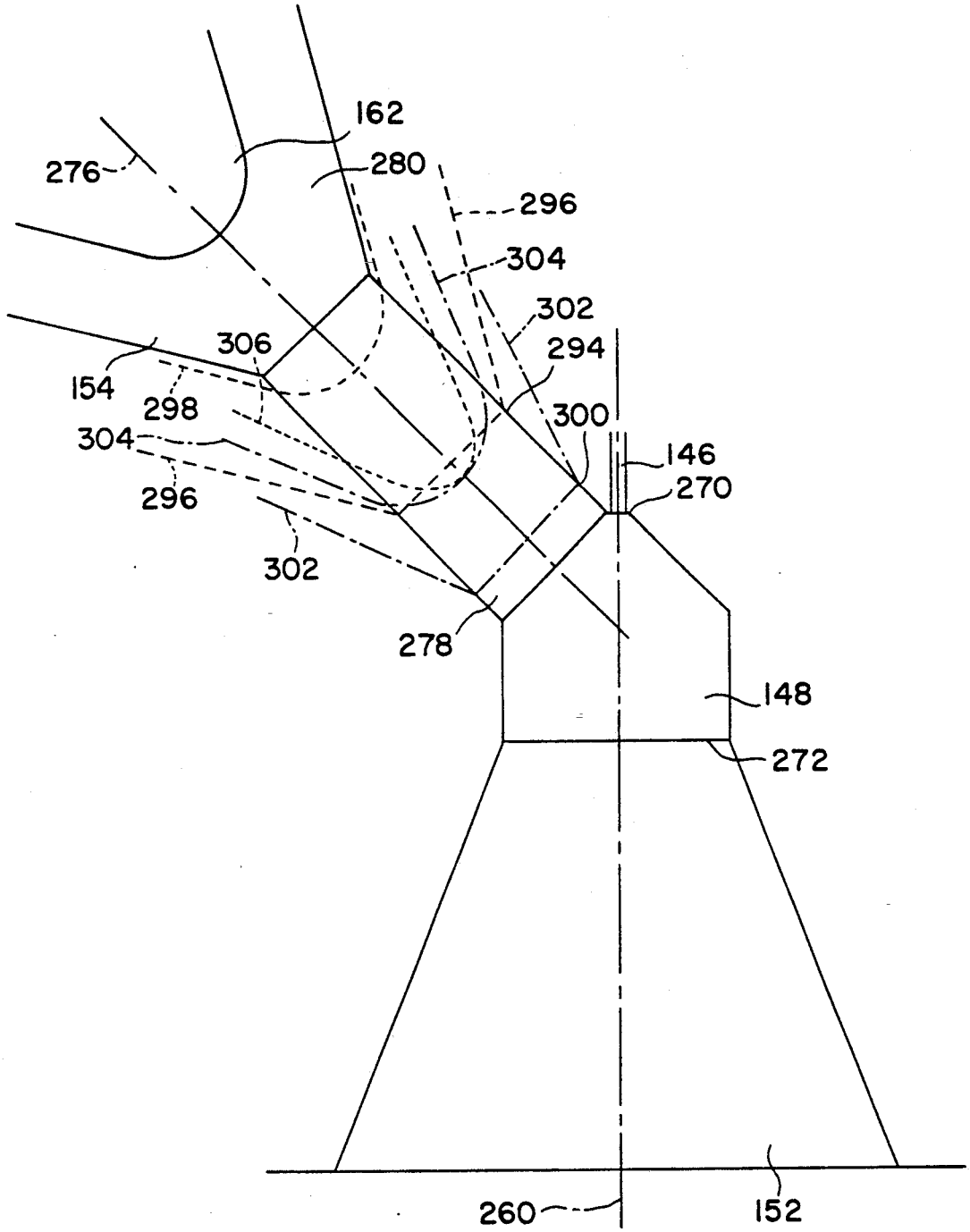
FIG. 11 is a sectional representation of a portion of the plasma gun of FIGS. 2 and 3 illustrating four different possible arc chamber configurations.

FIG. 11 is a sectional representation of the arc chamber 154 together with the central mixing chamber 148 and the central nozzle chamber 152. As previously noted, the arc chamber 154 is comprised of a partial conical portion 280 for receiving the cathode tip 162 and an adjoining cylindrical portion 278. The cylindrical portion 278 communicates with the central mixing chamber 148 adjacent the first end 270 thereof. The swirling inert gas which flows over the cathode tip 162 and into the central mixing chamber 148 via the arc chamber 154 combines with the electrical potential difference between the cathode tip 162 and the body 150 of the anode assembly 106 to produce a plasma arc. The plasma arc extends from the cathode tip 162 through the arc chamber 154 to the region of the central mixing chamber 148. The shape and the size of the arc chamber 154 combine with such things as the pressure and the amount of spiral of the gas to determine the path of the arc. The path of the arc in turn controls the temperature within the mixing chamber 148. The spiraling motion of the gas enhances the stability of the arc by moving the arc slightly so that it does not concentrate in one location on the walls of the central mixing chamber 148. The arc chamber 154 is contained within the body 150 of the anode assembly 106. Due to the modular nature of the anode assembly 106, the anode assembly 106 can easily be replaced within the plasma gun 16. By providing a plurality of different anode assemblies 106, each with arc chambers 154 of different size and/or shape, the anode assembly 106 can easily be changed to provide arc chambers 154 of different size and/or shape for different applications of the plasma system.

The operation of the plasma gun 16 is also controlled to some extent by the angle of the cathode assemblies 84, 86 and 88 relative to the central axis 260 of the anode assembly 106. In the present example, and as shown in particular by FIG. 11, the central axis 276 of the cathode assembly 84 and the central axes of the cathode assemblies 86 and 88 form angles of approximately 45° with the central axis 260 of the anode assembly 106. Such angle has been found to be satisfactory for most applications of the plasma system. Nevertheless, other angles can be used, and apparatus in accordance with the invention has been successfully operated over a range of such angles of 30°–105°. However, angles substantially in excess of 45° such as 90° have been found to result in unwanted deposition of the powdered material on the walls of the central mixing chamber 148.

FIG. 11 depicts four different arrangements of the arc chamber 154. The arrangement shown in FIG. 11 in solid outline is preferred for most applications of the plasma gun 16 in the present example. However, other arrangements shown may be preferred for different applications of the plasma gun 16.

In a second arrangement of the arc chamber 154 shown in FIG. 11, the cylindrical portion 278 is considerably shorter in length than in the case of the first arrangement, and terminates at a location 294 where the partial conical portion 280 begins. The outline of the partial conical portion 280 in the second arrangement is shown by a dashed line 296. The cathode tip 162 in the second arrangement assumes a position represented by a dashed line 298.

In a third arrangement of the arc chamber 154 shown in FIG. 11, the cylindrical portion 278 is even shorter and terminates at a location 300 where the partial conical portion 280 begins. The configuration of the partial conical portion 280 is represented by a line 302 of alternating dots and dashes. The position of the cathode tip 162 in the third arrangement is represented by a line 304 of alternating dots and dashes.

In a fourth arrangement of the arc chamber 154 shown in FIG. 11, the cylindrical portion 278 is the same as in the third arrangement and terminates at the location 300. Also, the partial conical portion 280 is the same as in the third arrangement and is represented by the line 302 of alternating dots and dashes. However, the cathode tip 162 in the fourth arrangement is of more slender configuration and is represented by a dotted line 306.

The presence of the central mixing chamber 148 in accordance with a feature of the invention provides for the mixing of powder from the powder feed port 146 into the plasma stream within the sonic region defined by the mixing chamber 148 before the mixture is accelerated within the supersonic region defined by the central nozzle chamber 152. Because different powdered materials to be mixed into the plasma stream melt at different temperatures and thus have different melting points, it is desirable to be able to vary the length of the central mixing chamber 148. Proper selection of the length of the mixing chamber 148 prevents premature melting and unwanted deposition of the powdered material on the walls of the mixing chamber 148 or the nozzle chamber 152. Because of the interchangeable nature of the modular anode assembly 106, it is possible to provide a plurality of different anode assemblies 106 and having mixing chambers 148 of different length. Depending upon the powder to be sprayed and the particular requirements thereof, the anode assembly 106 can be changed to install an anode assembly 106 with a mixing chamber 148 that will optimize performance. The mixing chamber 148 also influences the shape of the spray pattern of the powdered material, which pattern tends to be generally triangular where three cathodes are present. Variations in the mixing chamber 148 have been found to produce variations in the triangular shape of the spray pattern.

Figure 14:
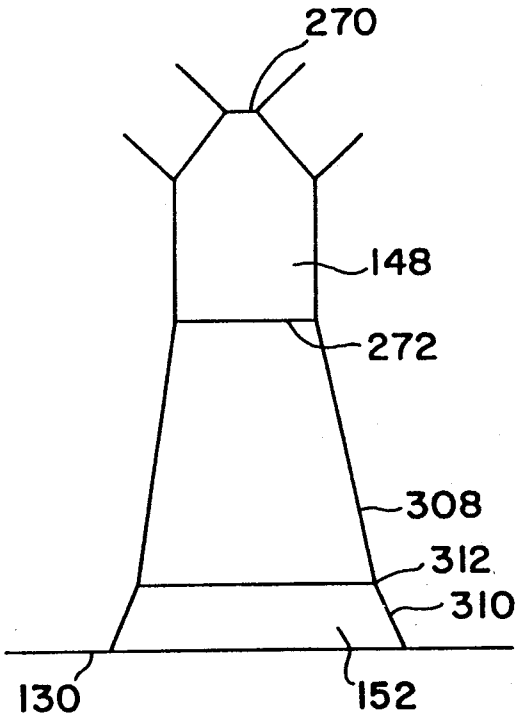
FIGS. 12–14 are sectional representations of a portion of the modular anode of FIG. 3 illustrating three different possible configurations of central mixing chambers and adjoining nozzle chambers.
Figure 13:
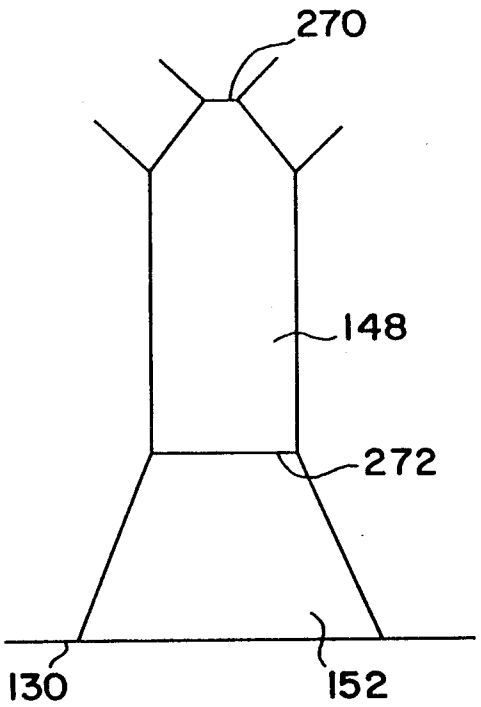
Figure 12:
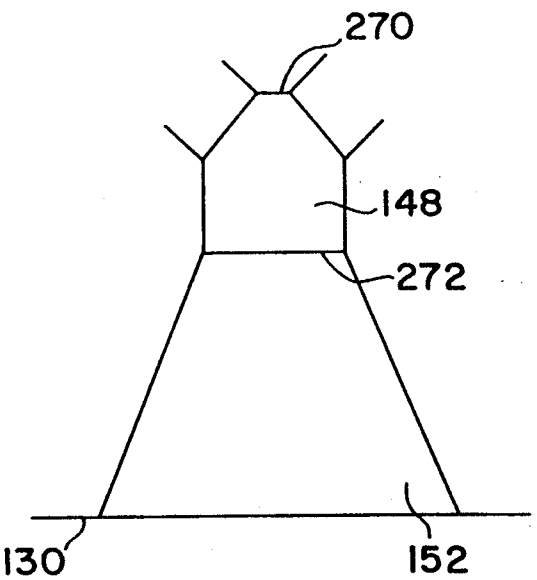

FIGS. 12, 13 and 14 show three different arrangements of mixing chambers 148, which arrangements involve differences in the nozzle chamber 152 to accommodate differences in the mixing chamber 148 so that performance may be optimized. A first such arrangement which is shown in FIG. 12 is similar to what is shown in FIGS. 3, 8 and 11. In the second arrangement of FIG. 13, the mixing chamber 148 is substantially longer than in the arrangement of FIG. 12, and the nozzle chamber 152 is correspondingly shorter. In the third arrangement of FIG. 14, the length of the mixing chamber 148 is slightly longer than in the first arrangement of FIG. 12 but considerably shorter than in the second arrangement of FIG. 13. The nozzle chamber 152 is divided into two different portions 308 and 310 of different divergence. The portion 308 extends from the second end 272 of the mixing chamber 148 with a generally constant rate of divergence to a location 312 where the portion 310 begins. The portion 310 extends from the location 312 to the base 130 with a constant rate of divergence that is greater than the rate of divergence of the portion 308.

The powder insert holder 136 which is shown in section in FIG. 3 is shown in FIG. 15 together with the powder insert 138 which is adapted to be mounted therein. As shown in FIG. 3, the powder insert holder 136 extends along the inside of the insert clamp 126 and terminates within the circular chamber 266 shown in FIG. 8. As shown in FIG. 15 the powder insert holder 136 has an annular recess 314 therein adjacent the upper end thereof for receiving an O-ring (not shown) to form a seal with the upper portion 132 of the insert clamp 126. The powder insert holder 136 also has an annular recess 316 adjacent a lower end thereof for receiving an O-ring (not shown) to form a seal with the circular chamber 266 within the body 150 of the anode assembly 106.

As shown in FIG. 15 the powder insert 138 is provided with threads which are received within the lower portion of the powder insert holder 136 to mount the powder insert 138 therein. With the powder insert holder 136 mounted within the insert clamp 126 and the anode assembly 106, the powder insert 138 is disposed within the cylindrical aperture 268 within the body 150 of the anode assembly 106. Material which is supplied by the powder tube 72 and the powder tube spout 124 is fed via the central bore 144 of the powder insert holder 136 to the central mixing chamber 148. The powder insert 138 has a lower tip 320 thereof which is disposed at the first end 270 of the central mixing chamber 148. The powder insert 138 is provided with either one or a plurality of different powder feed ports to feed powder into the mixing chamber 148 in various different configurations as described hereafter in connection with FIGS. 16–25.

One of the major advantages of a multi-cathode configuration is that by locating plural cathodes around the anode, a central powder delivery is facilitated. The use of the separate, replaceable powder insert 138 in accordance with a feature of the invention provides for considerable flexibility. The ability to use different powder inserts allows for variations in the material injection point within the mixing chamber 148. Also, the configuration and the diameter of the powder feed port or ports can be varied, as can the material of the powder insert 138. In accordance with a further feature of the invention discussed hereafter, each of the three different arc chambers 154 is provided with its own powder feed port. Powder inserts 138 having a variety of different multi-feed port configurations are described hereafter in connection with FIGS. 15–25. An important aspect of having the separate, replaceable powder insert 138 is that the angle of the various feed ports within the respective arc chambers can be varied to optimize performance.

Figure 16:
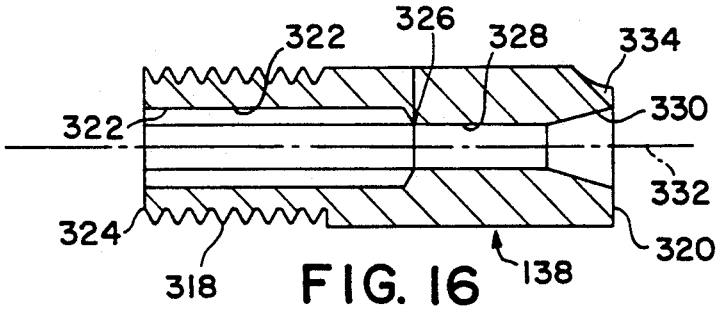
FIGS. 16 and 17 are respectively sectional and end views of a first embodiment of the powder insert of FIG. 15.
Figure 17:
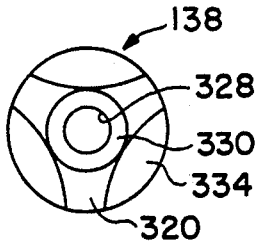

FIGS. 16 and 17 show one arrangement of the powder insert 138 in which a single powder feed port is employed. As shown in the sectional view of FIG. 16, powder insert 138 has a central bore 322 therein extending along a portion of the length of the powder insert 138 from a threaded end 324 thereof opposite the lower tip 320. The central bore 322 extends along a portion of the length of the powder insert 138 from the threaded end 324 to a location 326 at which the bore 322 terminates. A single powder feed port 328 extends along the remainder of the length of the powder insert 138 from the location 326 to the lower tip 320. The terminus of the powder feed port 328 comprises a portion 330 of diverging, partially conical configuration. The powder feed port 328 including the portion 330 thereof extends along a central axis 332 of the powder insert 138, as does the central bore 322.

With the powder insert 138 of FIGS. 16 and 17 installed within the anode assembly 106, the central axis 332 thereof is coincident with the central axis 260 of the anode body 150 and the central axis 92 of the body 70 of the plasma gun 16. The lower tip 320 of the powder insert 138 terminates at the first end 270 of the central mixing chamber 148 so that powder introduced into the central bore 322 of the powder insert 138 is introduced into the mixing chamber 148 along the central axis of the mixing chamber 148. As best shown in FIG. 17 the lower tip 320 of the powder insert 138 is provided with three different rounded grooves or flutes 334 generally equally spaced about the tip 320.

Figure 18:
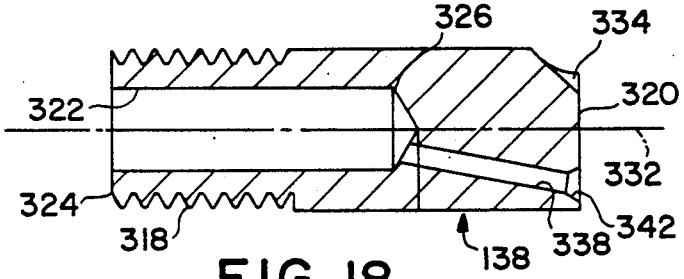
FIGS. 18 and 19 are respectively sectional and end views of a second embodiment of the powder insert of FIG. 15.
Figure 19:
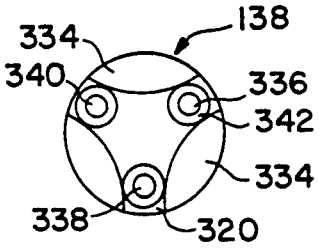

In multi-segmented cathode plasma guns of the type described, improved performance has been found where the powder is delivered separately by a plurality of different powder feed ports to the different arc chambers 154. FIGS. 18 and 19 show one particular arrangement of the powder insert 138 which employs three different powder feed ports 336, 338 and 340. All three of the powder feed ports 336, 338 and 340 are shown in FIG. 19. Only the lower powder feed port 338 is shown in the sectional view of FIG. 18. The three powder feed ports 336, 338 and 340 extend from the location 326 at the end of the central bore 322 to the lower tip 320 in generally straight-line fashion so as to form relatively small acute angles with the central axis 332. Each of the powder feed ports 336, 338 and 340 terminates at the lower tip 320 in an outwardly diverging portion 342 thereof. When the powder insert 138 shown in FIGS. 18 and 19 is installed in the anode assembly 106, each of the powder feed ports 336, 338 and 340 terminates at a different one of the arc chambers 154 adjacent the juncture of the arc chamber 154 with the first end 270 of the central arc chamber 148.

Where multiple powder feed ports are used in conjunction with a multi-segmented cathode plasma gun, the performance of the gun has been found to vary in accordance with such things as the angle and the size of the powder feed ports. Because of the easily replaceable nature of the powder insert 138, it may be advantageous to provide a number of different configurations of the powder insert 138 for different applications.

Figure 20:
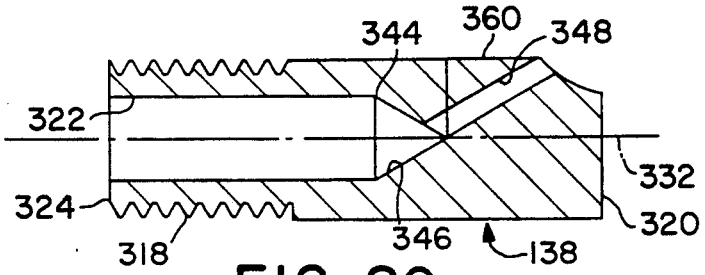
FIGS. 20 and 21 are respectively sectional and end views of a third embodiment of the powder insert of FIG. 15.
Figure 21:
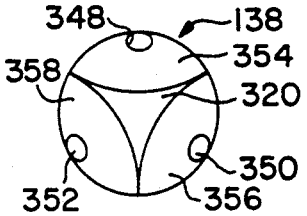

The arrangement shown in FIGS. 20 and 21 is similar to the arrangement of FIGS. 18 and 19 to the extent that the central bore 322 extends from the threaded end 324 to a location 344 within a central portion of the length of the powder insert 138. Beyond the location 344, the central bore 322 terminates in a generally conical portion 346 thereof. Three different powder feed ports 348, 350 and 352 which are generally equally spaced about the central axis 332 extend from the conical portion 346 to the lower tip 320 of the powder insert 138. In the arrangement of FIGS. 20 and 21, most of the lower tip 320 is comprised of three relatively large flutes 354, 356 and 358. The powder feed ports 348, 350 and 352 terminate at portions of the flutes 354, 356 and 358 adjacent a cylindrical side surface 360 of the powder insert 138. The powder feed ports 348, 350 and 352 do not terminate in outwardly diverging portions such as the portion 330 of the arrangement of FIGS. 16 and 17 and the portion 342 of the arrangement of FIGS. 18 and 19. Also, the powder feed ports 348, 350 and 352 form acute angles with the central axis 332 which are substantially larger than the acute angles formed by the powder feed ports 336, 338 and 340 with the central axis 332 in the arrangement of FIGS. 18 and 19.

Figure 22:
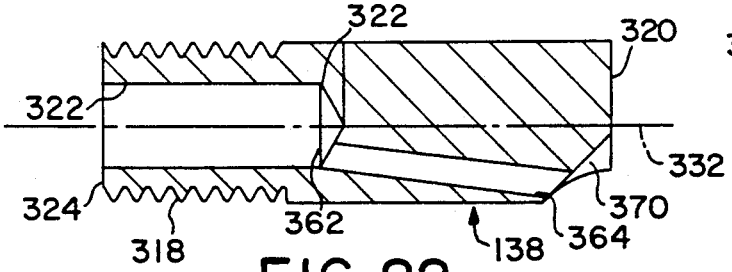
FIGS. 22 and 23 are respectively sectional and end views of a fourth embodiment of the powder insert of FIG. 15.
Figure 23:
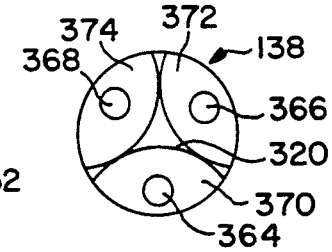

In the arrangement of the powder insert 138 shown in FIGS. 22 and 23, the central bore 322 is shorter in length than in the arrangements of FIGS. 16-21. The central bore 322 terminates at a location 362. Three different powder feed ports 364, 366 and 368 which are generally equally spaced about the central axis 332 extend from the end of the central bore 322 at the location 362 to the lower tip 320. The lower tip 320 is principally comprised of three different flutes 370, 372 and 374, with each of the powder feed ports 364, 366 and 368 terminating at one of the flutes 370, 372 and 374. Each of the powder feed ports 364, 366 and 368 in the arrangement of FIGS. 22 and 23 forms a relatively small acute angle with the central axis 332 similar to the acute angle formed by each of the powder feed ports 336, 338 and 340 with the central axis 332 in the arrangement of FIGS. 18 and 19. However, in the arrangement of FIGS. 22 and 23, the powder feed ports 364, 366 and 368 are of considerably larger diameter than are the powder feed ports 336, 338 and 340 of the arrangement of FIGS. 18 and 19 or for that matter the powder feed ports 348, 350 and 352 of the arrangement of FIGS. 20 and 21. As in the arrangement of FIGS. 20 and 21, the powder feed ports 364, 366 and 368 of the arrangement of FIGS. 22 and 23 terminate at the flutes 370, 372 and 374 without the presence of outwardly diverging portions.

Figure 24:
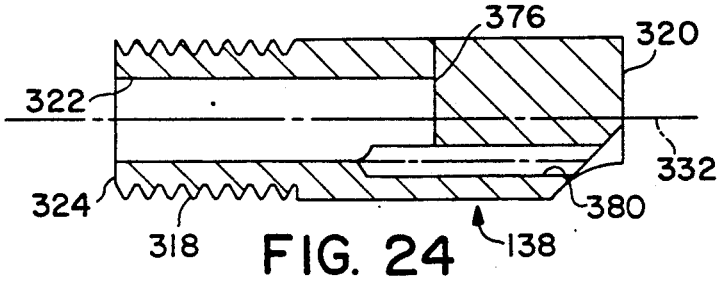
FIGS. 24 and 25 are respectively sectional and end views of a fifth embodiment of the powder insert of FIG. 15.
Figure 25:
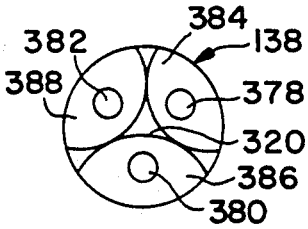

In the arrangement of the powder insert 138 shown in FIGS. 24 and 25, the central bore 322 extends from the threaded end 324 along a substantial portion of the length of the insert 138 to a location 376. Three different powder feed ports 378, 380 and 382 which are generally parallel to and equally spaced about the central axis 332 extend from the end of the central bore 322 adjacent the location 376 to different ones of three different flutes 384, 386 and 388 within the lower tip 320 of the powder insert 138. The powder feed ports 378, 380 and 382 are of relatively large diameter as in the case of the powder feed ports 364, 366 and 368 of the arrangement of FIGS. 22 and 23.

A major advantage of multi-segmented electrodes in plasma guns such as the multi-segmented cathode plasma gun 16 is the ability to scale up operation thereof to power levels considerably in excess of those which are achievable in connection with single cathode plasma guns. Such scale up is made possible by the presence of the multi-segmented electrodes and by observing and adjusting the various factors previously described to optimize operation of the plasma system in the face of the multi-segmented electrodes. However, the increased power levels bring with them a greater cooling requirement, particularly in the case of the anode assembly which is common to the entire plasma gun 16. The cathode assemblies 84, 86 and 88 are independently and separately cooled with each having its own cooling system, as previously described in connection with FIGS. 2 and 5.

Referring to FIG. 2, it was previously noted that the water booster pump 52 supplies cooling water to the fittings 76 and 78 on the anode connection plate 74 of the plasma gun 16 via two of the cooling water supply conduits 75. After the cooling water has been circulated through the anode cooling system which is described hereafter, the water exits via the fittings 80 and 82 and is returned to the water booster pump 52 by two of the cooling water return conduits 79.

Figure 26:
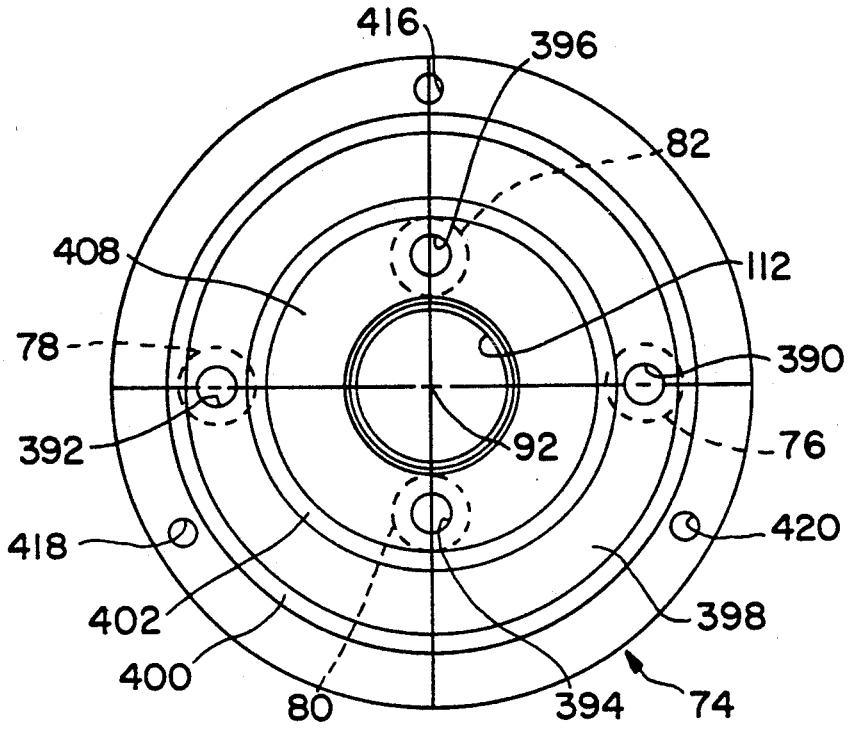
FIG. 26 is a bottom view of the anode connector plate of the plasma gun of FIGS. 2 and 3.

FIG. 26 is a bottom view of the anode connection plate 74 showing the locations of the fittings 76, 78, 80 and 82 on the other side thereof in dotted outline. The fittings 76 and 78 which are spaced at like radial distances from the central axis 92 on opposite sides of the central axis 92 communicate with the underside of the anode connection plate 74 via apertures 390 and 392 respectively. The fittings 80 and 82 which are disposed on opposite sides of the central axis 92 by like radial distances smaller than the radial distances of the fittings 76 and 78 from the axis axis 92 and 90° removed from the fittings 76 and 78 relative to the central axis 92 are coupled to the bottom of the anode connection plate 74 by apertures 394 and 396 respectively. The apertures 390 and 392 lie within an annular path 398 around the bottom of the anode connector plate 74, which annular path 398 is defined by a pair of concentric grooves 400 and 402 in the bottom of the anode connection plate 74. The grooves 400 and 402 contain seals 404 and 406 respectively which are shown in FIG. 3. With the anode connection plate 74 mounted on the top 102 of the gun body 70, the seals 404 and 406 act to seal the annular path 398 around the bottom of the anode connection plate 74 from areas of the plate 74 outside of the groove 400 and from an inner annular path 408 disposed between the groove 402 and the central aperture 112 of the anode connection plate 74. The apertures 394 and 396 which communicate with the fittings 80 and 82 reside within the inner annular path 408.

Figure 27:
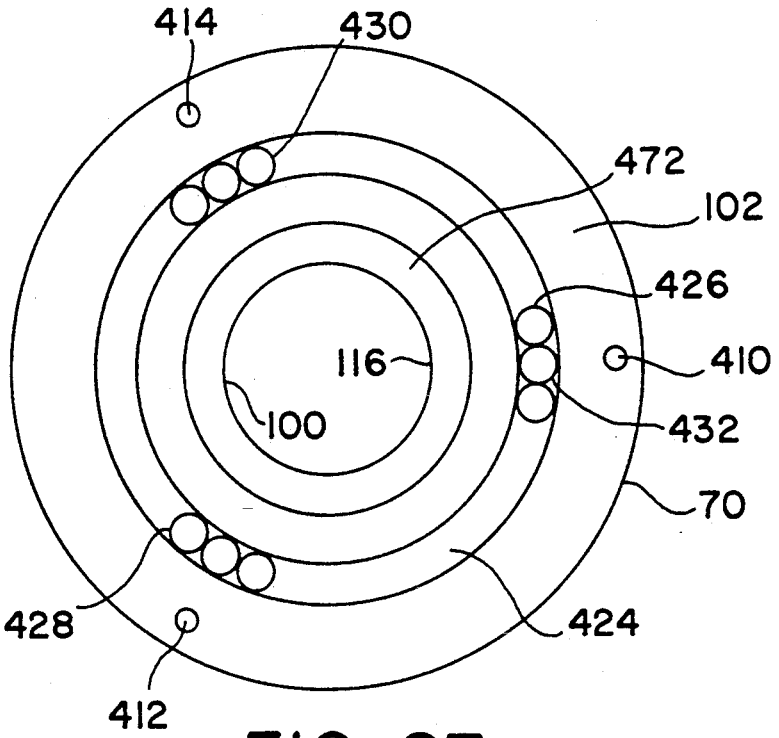
FIG. 27 is a top view of the gun body of the plasma gun of FIGS. 2 and 3.

FIG. 27 is a top view of the gun body 70 with the anode connection plate 74 removed. As such, FIG. 27 shows the top 102 of the body 70 together with the cylindrical bore 100 through the body 70. The top 102 of the body 70 is provided with three threaded apertures 410, 412 and 414 which align with corresponding apertures 416, 418 and 420 at the outer periphery of the anode connection plate 74 when the plate 74 is mounted on the top 102 of the body 70. Bolts are placed through the apertures 416, 418 and 420 in the anode connection plate 74 and are screwed into the threaded apertures 410, 412 and 414 to secure the anode connection plate 74 on the top 102 of the body 70. One such bolt 422 is shown in FIG. 3.

Referring again to FIG. 27, the top 102 of the gun body 70 is provided with an annular cavity 424 therein. The annular cavity 424 is connected to the bottom 104 of the body 70 by three different groups 426, 428 and 430 of three apertures each. One such aperture 432 comprising one of the three apertures of the group 426 is shown in the section view of FIG. 3. With the anode connection plate 74 mounted on the top 102 of the body 70, the annular cavity 424 is generally coextensive with the annular path 398 at the bottom of the anode connection plate 74. Cooling water entering the gun body 70 via the fittings 76 and 78 flows through the apertures 390 and 392 and into the annular cavity 424. From the annular cavity 424, the cooling water flows downwardly through the groups of apertures 426, 428 and 430 to the bottom 104 of the gun body 70. The flow of cooling water is represented by arrows 434 within the aperture 432 and elsewhere throughout FIG. 3.

Figure 28:
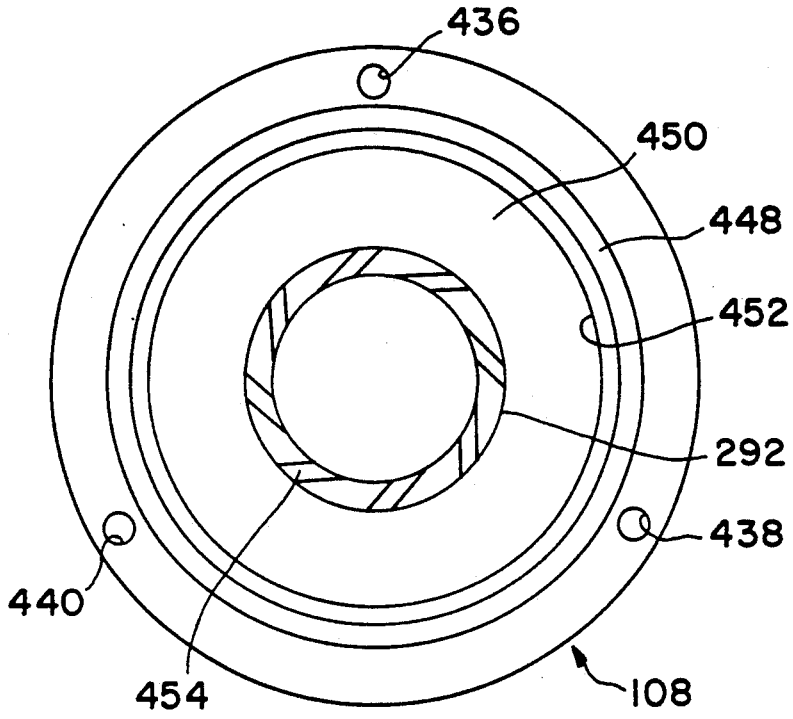
FIG. 28 is a top view of the anode retainer of the plasma gun of FIGS. 2 and 3.

FIG. 28 is a top view of the anode retainer 108. The anode retainer 108 has three different apertures 436, 438 and 440 therein adjacent the outer periphery thereof. The anode retainer 108 is secured to the bottom 104 of the gun body 70 by bolts which extend through the apertures 436, 438 and 440 and into mating threaded apertures in the bottom 104 of the body 70. FIG. 3 shows one such bolt 442 extending into one such threaded aperture 444 through the aperture 436 in the anode retainer 108.

With the anode retainer 108 bolted in place on the bottom 104 of the gun body 70, a seal 446 disposed within an annular groove 448 in the top surface of the anode retainer 108 abuts the bottom 104 of the gun body 70 as shown in FIG. 3 to seal an annular cavity 450 within the anode retainer 108 from the outer peripheral portions of the anode retainer 108. The annular cavity 450 which extends between the circular flange 292 and a circular wall 452 just inside of and concentric with the annular groove 448 is disposed beneath and in communication with the groups of apertures 426, 428 and 430 in the gun body 70. Cooling water flowing downwardly through the groups of apertures 426, 428 and 430 enters the annular cavity 450 where it surrounds the circular flange 292. The circular flange 292 has an array of angled slots 454 therein as shown in FIG. 28. Because the slots 454 are angled about the circular flange 292, the cooling water is forced into a swirling, spiral pattern as it is forced under pressure from the annular cavity 450 through the slots 454.

As previously noted in connection with FIG. 8 the anode assembly 106 is provided with an annular cavity 282 that surrounds the base 130 thereof. The annular cavity 282 which is also shown in FIG. 3 receives the swirling, spiraling cooling water at the inside of the circular flange 292. This swirling, spiraling action of the cooling water maximizes the heat exchange which takes place through the walls of the anode assembly 106 between the annular cavity 282 and the nozzle chamber 152.

The swirling, spiraling cooling water within the annular cavity 282 leaves the cavity 282 by flowing upwardly through apertures or passages in the body 150 of the anode assembly 106 such as the apertures 284 and 286 shown in FIG. 3 as well as in FIGS. 8 and 10. The apertures or passages which extend upwardly between the various arc chambers 154 provide additional cooling of the anode assembly 106 in that region.

Figure 29:
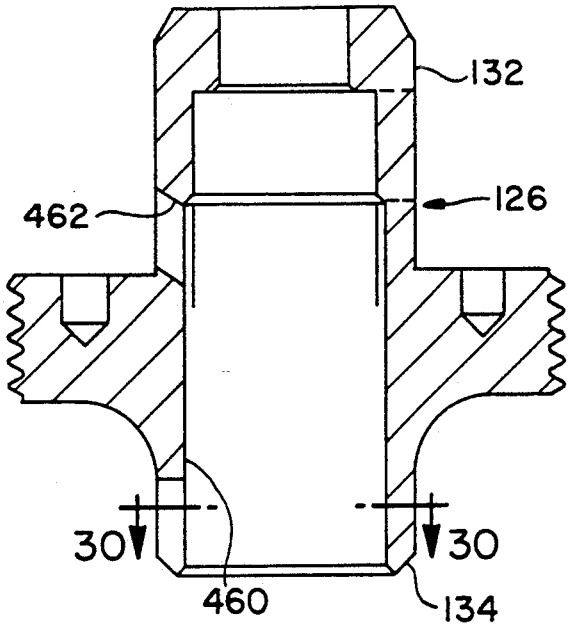
FIG. 29 is a sectional view of the insert clamp of the plasma gun of FIGS. 2 and 3.
Figure 30:
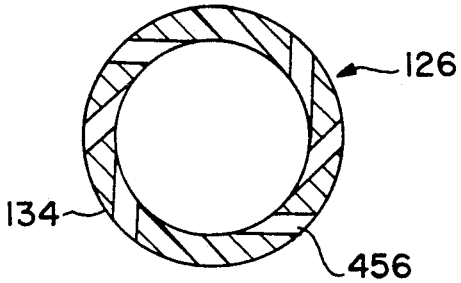
FIG. 30 is a sectional view of the insert clamp of FIG. 29 taken along the line 30—30 thereof and showing the arrangement of cooling water apertures in a lower portion of the insert clamp.
Figure 31:
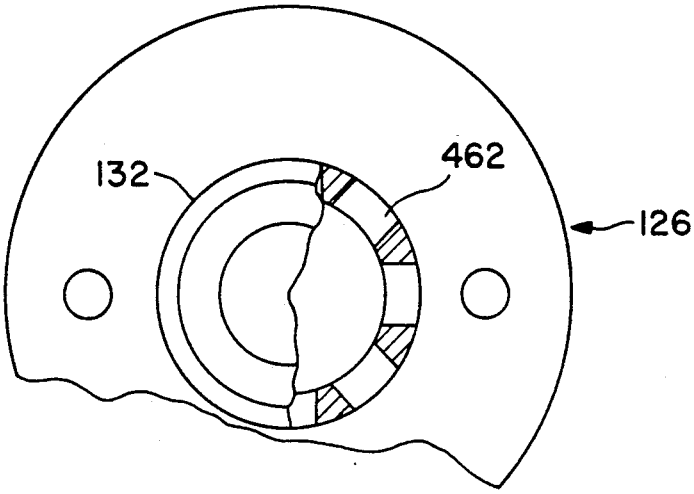
FIG. 31 is a top view, partially broken away and in section, of the insert clamp of FIG. 29 and showing the orientation of cooling water apertures in an upper portion of the insert clamp.

As the cooling water reaches the top ends of the apertures including the apertures 284 and 286, the water flows principally through the lower portion 134 of the insert clamp 126. FIG. 30 which is a sectional view of the insert clamp shown in FIG. 29 shows that the lower portion 134 thereof is provided with a plurality of angled apertures 456 therein disposed about the lower portion 134. This again forces the cooling water into a swirling, rotating pattern as the water is directed onto the outside of the powder insert holder 136, thereby providing considerable cooling of the powder insert holder 136. Such cooling action which occurs within an annular passage 458 formed between a hollow interior 460 of the insert clamp 126 and the outside of the powder insert holder 136 is particularly important because the powder insert holder 136 acts as a heat sink. The considerable heat generated within the central mixing chamber 148 passes upwardly through the powder insert 138 which is made of material such as tungsten to the powder insert holder 136 which is made of copper and which therefore acts as a heat sink. The swirling water within the annular passage 458 provides the substantial cooling action of the powder insert holder 136 as needed.

As the cooling water within the annular passage 458 continues flowing upwardly, such water is directed through a plurality of apertures 462 in the upper portion 132 of the insert clamp 126. Such apertures 462 which are angled upwardly but not relative to the central axis of the insert clamp 126 are shown in the partial sectional view of FIG. 31. Cooling water flowing through the apertures 462 enters an annular chamber 464 which lies outside of the upper portion 132 of the insert clamp 126 and beneath the flange 114 of the anode connector plug 110.

Figure 32:
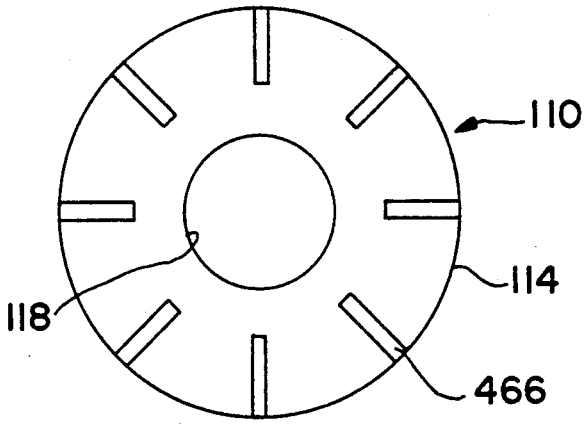
FIG. 32 is a bottom view of the anode connector plug of the plasma gun of FIGS. 2 and 3.

FIG. 32 is a bottom view of the anode connector plug 110 showing the bottom of the flange 114 thereof. As shown in FIG. 32 the flange 114 is provided with a series of eight different slots 466 therein generally equally spaced about the flange 114. The slots 466 permit the cooling water within the annular chamber 464 to pass therethrough on the way to an annular passage 468 formed between an outer surface 470 of the anode connector plug 110 and the cylindrical bore 100 in the gun body 70.

Cooling water which flows into the annular passage 468 flows upwardly to an annular recess 472 in the top 102 of the gun body 70. The annular recess 472 which surrounds the cylindrical bore 100 is disposed adjacent the inner annular path 408 at the underside of the anode connection plate 74. Consequently, cooling water within the annular recess 472 flows upwardly through the apertures 394 and 396 to the fittings 80 and 82. From the fittings 80 and 82, the cooling water returns to the water booster pump 52 via two of the cooling water return conduits 79.

An examination of FIG. 26 as well as FIG. 2 shows that the fitting 76 is approximately 90° removed from the fitting 82 relative to the central axis 92. For convenience of illustration, however, the fitting 76 is shown in FIG. 3 as being disposed directly across from the fitting 82 in line with the central axis 92.

The plasma gun 16 has thus far been described in connection with the delivery of spray material in powdered form. The introduction of metal or other material to be sprayed into the plasma stream in powdered form is well known in the art. The powdered form of the spray material enables the material to be delivered to the appropriate location within the plasma gun through relatively long and in some cases relatively tortuous feed paths. Plasma guns having a single cathode centrally disposed above the anode, for example, typically have such a difficult powder feed path which enters the side of the plasma gun.

While metals or other materials in powdered form are relatively easy to handle and to deliver to the inside of the plasma gun through feed paths that may be long or tortuous, the need to provide such materials in powdered form carries with it certain disadvantages. For one thing, materials such as metals are difficult and expensive to produce in powdered form. Once produced, such powdered materials often require special handling so as to minimize such things as oxidation thereof. For this reason it would be advantageous to be able to introduce the spray material in liquid or molten form. Such an approach is facilitated by multi-segmented plasma guns where the material delivery is accomplished through a central portion of the gun at the top of the anode assembly. This provides for the use of relatively short and direct material delivery apparatus so that the dangers of the molten material solidifying along the way or otherwise encountering problems are thereby minimized.

Figure 33:
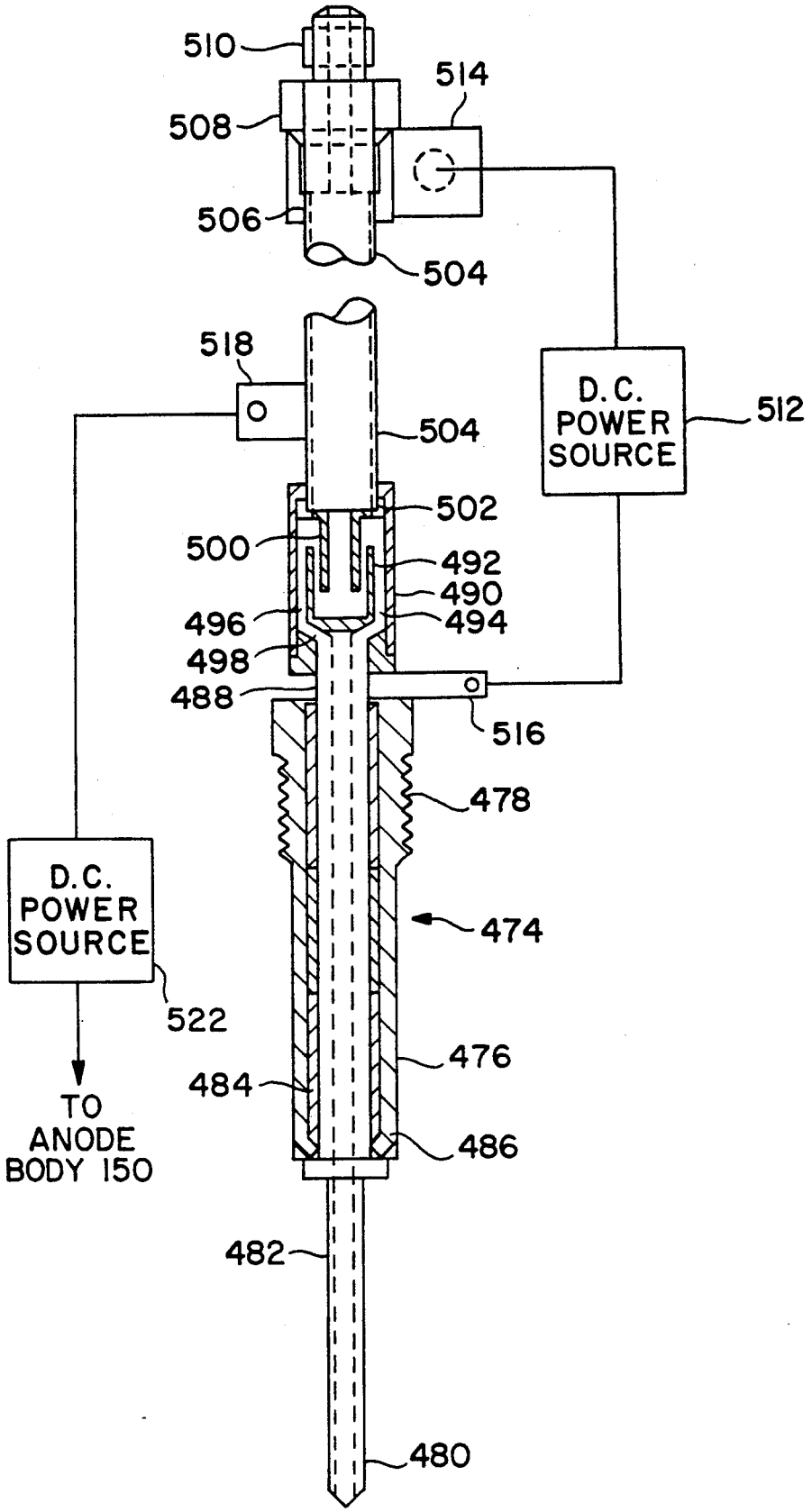
FIG. 33 is a plan view, partly in section, of a metal melt-feed assembly for feeding molten metal to be sprayed into the anode of FIGS. 3 and 8–10.

FIG. 33 provides an example of apparatus which may be used to deliver metal or other material to be sprayed in molten form in accordance with the invention. The apparatus shown in FIG. 33 comprises a metal melt-feed assembly 474. The assembly 474 is designed to be installed in the plasma gun 16 where it replaces the powder tube 72, the feed tube retainer 120, the powder tube spout 124, the powder insert holder 136 and the powder insert 138. The metal melt-feed assembly 474 shown in FIG. 33 has its own feed tube retainer 476 which is of similar configuration to the feed tube retainer 120 shown in FIG. 3. The feed tube retainer 476 has a threaded upper portion 478 thereof which is screwed into the mating threaded portion of the anode connector plug 110 when the assembly 474 is installed within the plasma gun 16. With the feed tube retainer 476 installed within the anode connector plug 110, a lower end 480 of a hollow feed tube 482 mounted within a hollow, generally cylindrical insulator 484 on the inside of the feed tube retainer 476 extends downwardly from a lower end 486 of the feed tube retainer 476. The lower end 480 of the hollow feed tube 482 extends through the cylindrical aperture 268 to the first end 270 of the central mixing chamber 148 in the anode assembly 106.

The hollow feed tube 482 has an upper end 488 thereof which terminates within a generally cylindrical feed tube connector 490 having a melt bowl 492 therein. The melt bowl 492 which is of hollow, generally cylindrical configuration is disposed within and forms an annular passage 494 with an inner wall 496 of the feed tube connector 490. A lower end 498 of the annular passage 494 extends inwardly and terminates at the open upper end 488 of the hollow feed tube 482. A spout 500 extends partly into the hollow interior of the melt bowl 492 from a lower end 502 of a hollow supply tube 504. The spout 500 is seated within an upper end of the feed tube connector 490.

The hollow supply tube 504 terminates at an upper end 506 thereof which has a plug 508 received therein. Coupled to the plug 508 is a gas fitting 510. The plug 508 with its included gas fitting 510 may be removed from the upper end 506 of the hollow supply tube 504 to provide access to the interior of the supply tube 504. With the plug 508 removed from the upper end 506 of the supply tube 504, the hollow interior of the supply tube 504 may be filled with solid pieces of metal or other material to be sprayed. The plug 508 is then replaced on the upper end 506 of the supply tube 504 and power is applied to heat the metal within the supply tube 504. The power is supplied by a D.C. power source 512 which is coupled to a pair of electrodes 514 and 516. The electrode 514 is coupled to the hollow supply tube 504 at the upper end 506 thereof. The electrode 516 is coupled to the hollow feed tube 482 between the top of the feed tube retainer 476 and the bottom of the feed tube connector 490.

The electrodes 514 and 516 are shown in large, symbolic form in FIG. 33, but in actuality are of much more compact configuration to facilitate installation of the metal melt-feed assembly 474 within the plasma gun 16. Similar comments apply to an electrode 518. The electrode 518 is coupled to the hollow supply tube 504 adjacent the lower end 502 thereof. A D.C. power source 522 is coupled between the electrode 518 and the anode body 150.

The D.C. power source 512 when coupled to the electrodes 514 and 516 generates enough heat within the hollow supply tube 504 to melt the solid pieces of metal placed therein. The D.C. power source 522 when coupled to the electrode 518 and the anode body 150 provides enough heat to prevent the molten metal from solidifying when it is delivered from the hollow supply tube 504 through the melt bowl 492 and the hollow feed tube 482 to the central mixing chamber 148 within the anode assembly 106.

As the solid pieces of metal within the hollow supply tube 504 melt in response to the application of the D.C. power source 512, the molten metal flows downwardly through the spout 500 and into the melt bowl 492. The molten metal fills the melt bowl 492 but does not overflow the top of the melt bowl 492 and into the annular passage 494 due to the action of gas pressure communicated from the central mixing chamber 148 of the anode assembly 106. The introduction of inert gas into the cathode assemblies 84, 86 and 88 to form the plasma arcs and the resulting plasma stream as previously described creates a gas pressure within the central mixing chamber 148. This gas pressure is communicated upwardly through the hollow interior of the feed tube 482 and the annular passage 494 to the top of the melt bowl 492 where such gas pressure prevents the molten metal from flowing over the top of the melt bowl 492. The resulting state of equilibrium is maintained in the presence of the molten metal until such time as it is desired to deliver the molten metal into the central mixing chamber 148 of the anode assembly 106.

When delivery of the molten metal from the melt bowl 492 into the central mixing chamber 148 of the anode assembly 106 is desired, gas pressure is applied to the upper end 506 of the hollow supply tube 504. While not shown in FIG. 33, a gas line is adapted to selectively couple a source of inert gas such as argon to the gas fitting 510 at the top of the plug 508. Application of the argon gas to the hollow interior of the supply tube 504 at the upper end 506 thereof overcomes the effects of the gas pressure from the central mixing chamber 148, causing the molten metal within the melt bowl 492 to flow over the top thereof and down through the annular passage 494 and through the lower end 498 to the hollow interior of the feed tube 482. The molten metal flows down through the hollow interior of the feed tube 482 and into the central mixing chamber 148 within the anode assembly 106 where it is mixed into the plasma stream. The D.C. power source 522 provides enough heat to prevent unwanted solidification of the molten metal as it flows through this downward path.

When it is desired to terminate delivery of the molten metal into the central mixing chamber 148 of the anode assembly 106, application of the argon gas to the fitting 510 is terminated. This again allows the gas pressure within the central mixing chamber 148 to establish an equilibrium condition in which the molten metal no longer overflows the top of the melt bowl 492.

While various forms and modifications have been suggested, it will be appreciated that the invention is not limited thereto but encompasses all expedients and variations falling with the scope of the appended claims.

What is claimed is:

1. A plasma system comprising the combination of:

a plasma gun positioned in operative relation to a workpiece and providing a supersonic plasma system of substantially inert gas, the plasma gun having a central mixing chamber and a plurality of electrodes of a first polarity surrounding a common electrode of a second polarity opposite the first polarity, each of the plurality of electrodes of a first polarity including an annular chamber extending into the central mixing chamber and means for injecting an inert gas into the annular chamber in a swirling pattern;

an enclosure surrounding the plasma gun and the workpiece; and means for establishing an ambient pressure of 0.6–0.001 atmospheres within the enclosure.

2. The invention as set forth in claim 1, wherein the means for establishing a pressure environment includes at least one vacuum pump coupled to the enclosure to establish the ambient pressure of 0.6–0.001 atmospheres therein.

3. The invention set forth in claim 1, wherein the common electrode comprises an anode having central powder delivery apparatus and the plurality of electrodes comprises a plurality of cathodes surrounding the common anode.

4. The invention set forth in claim 3, wherein the plasma gun includes a body in which the anode and the plurality of cathodes are mounted, and the anode is of modular construction and is readily removable from the body to facilitate replacement of the anode.

5. The invention set forth in claim 3, wherein the plasma gun includes a body in which the anode and the plurality of cathodes are mounted, and each of the plurality of cathodes is of modular construction to facilitate installation in and removal from the body and is pressure-sealed to seal an interior of the modular cathode from the pressure at an exterior of the modular cathode.

6. A plasma system comprising the combination of:

a plasma gun positioned in operative relation to a workpiece and having a common, centrally positioned anode and a plurality of cathodes spaced about the anode, each of the cathodes being positioned in plasma arc forming relation with the anode in response to the flow of substantially inert gas at the cathode and including means for providing the flow of substantially inert gas in a swirling pattern;

means for injecting spray powder into the anode;

an enclosure surrounding the plasma gun and the workpiece; and a vacuum source coupled to the enclosure to provide an ambient pressure of 0.6–0.001 atmospheres within the enclosure.

7. The invention set forth in claim 6, wherein the plasma system includes a transfer arc D.C. power supply coupled between the anode and the workpiece and a plurality of D.C. plasma power sources, each of which is coupled between the anode and a different one of the plurality of cathodes.

8. The invention set forth in claim 6, wherein the plasma gun includes an anode cooling system associated with the anode, a plurality of cathode cooling systems, each being associated with a different one of the plurality of cathodes and being separate from the other cathode cooling systems and the anode cooling system, a source of cooling liquid, and a plurality of conduits coupling each of the plurality of cathode cooling systems and the anode cooling system to the source of cooling liquid independent of the other cooling systems.

9. The invention set forth in claim 6, wherein the anode has a nozzle therein and a plurality of arc chambers therein communicating with the nozzle and each disposed adjacent a different one of the cathodes and the anode is of modular construction to facilitate replacement thereof within the plasma gun whereby the anode of the plasma gun can be relatively easily replaced in order to change the configuration of the arc chambers and the nozzle to optimize performance of the plasma system.

10. For use in a plasma gun having an anode, a plurality of cathodes and means for establishing a pressure environment substantially lower than atmospheric pressure adjacent the plurality of cathodes, a modular cathode assembly for providing one of the plurality of cathodes and comprising the combination of an enclosed, pressure-sealed housing having a hollow interior, a cathode tip structure mounted within the hollow interior of the housing, a fluid cooling system disposed within the hollow interior of the housing adjacent the cathode tip structure and having at least one fluid coupling at the exterior of the housing, and a gas supply system disposed within the hollow interior of the housing adjacent the cathode tip structure and having a gas coupling at the exterior of the housing and means for providing a flow of gas in a swirling pattern adjacent the cathode tip structure.

11. For use in a plasma gun having an anode and a plurality of cathodes, a modular cathode assembly for providing one of the plurality of cathodes and comprising the combination of an enclosed, pressure-sealed housing having a hollow interior, a cathode tip structure mounted within the hollow interior of the housing, a fluid cooling system disposed within the hollow interior of the housing adjacent the cathode tip structure and having at least one fluid coupling at the exterior of the housing, and a gas supply system disposed within the hollow interior of the housing adjacent the cathode tip structure and having a gas coupling at the exterior of the housing, the cathode tip structure including an elongated cathode connector tube having an axis of elongation and disposed within the hollow interior of the housing and a cathode tip coupled to an end of the cathode connector tube, the housing including a hollow chamber insulator surrounding and forming an annular space between an inner wall thereof and the cathode connector tube and the cathode tip, and the gas supply system including means coupling the annular space to the gas coupling and an annular collar disposed within the annular space between the cathode connector tube and the inner wall of the chamber insulator and having an array of apertures therein obliquely oriented relative to the axis of elongation of the cathode connector tube, whereby gas supplied to the gas coupling and passed to the annular space is forced by the array of apertures into a swirling pattern as it passes over the cathode tip.

12. For use in a plasma gun having an anode and a plurality of cathodes, a modular cathode assembly for providing one of the plurality of cathodes and comprising the combination of an enclosed, pressure-sealed housing having a hollow interior, a cathode tip structure mounted within the hollow interior of the housing, a fluid cooling system disposed within the hollow interior of the housing adjacent the cathode tip structure and having at least one fluid coupling at the exterior of the housing, and a gas supply system disposed within the hollow interior of the housing adjacent the cathode tip structure and having a gas coupling at the exterior of the housing, the cathode tip structure including a cathode connector tube having a hollow interior and a cathode tip coupled to an end of the cathode connector tube, and the fluid cooling system including an inner connector tube structure disposed within the hollow interior of the cathode connector tube and having a hollow interior, means coupling a supply of cooling fluid to the hollow interior of the inner connector tube structure, whereby cooling fluid flow along the hollow interior of the inner connector tube structure and then through a space at an exterior of the inner connector tube structure and within the hollow interior of the cathode connector tube, and means coupling the space to the at least one fluid coupling, whereby cooling fluid within the space exits to the at least one fluid coupling.

13. For use in a plasma gun having an anode and a plurality of cathodes, a modular cathode assembly for providing one of the plurality of cathodes and comprising the combination of an enclosed, pressure-sealed housing having a hollow interior, a cathode tip structure mounted within the hollow interior of the housing, a fluid cooling system disposed within the hollow interior of the housing adjacent the cathode tip structure and having at least one fluid coupling at the exterior of the housing, and a gas supply system disposed within the hollow interior of the housing adjacent the cathode tip structure and having a gas coupling at the exterior of the housing, the cathode tip structure including a cathode connector tube disposed within the hollow interior of the housing and a cathode tip having a threaded end thereof received within a mating threaded aperture in an end of the cathode connector tube.

14. A modular cathode assembly comprising the combination of:

a generally cylindrical cathode insulator connector having a hollow interior and opposite first and second ends;

a hollow, generally cylindrical cable insulator coupled to the first end of the cathode insulator connector;

a generally ring-shaped insulator retainer coupled to the second end of the cathode insulator connector and having a hollow interior;

a chamber insulator mounted within the hollow interior of the insulator retainer and a portion of the hollow interior of the cathode insulator connector, the chamber insulator extending outwardly from the insulator retainer opposite the cathode insulator connector and having a hollow interior;

a generally cylindrical gas conductor tube mounted within the hollow interior of the cathode insulator connector and forming an annular gas inlet chamber with the hollow interior of the cathode insulator connector, the gas conductor tube having a hollow interior and having apertures therein spaced around the annular gas inlet chamber, the cathode insulator connector having a passage therein connecting the annular gas inlet chamber to a location at an exterior of the cathode insulator connector;

an elongated cathode connector tube disposed within and forming a gas passage with the hollow interior of the gas conductor tube and the hollow interior of the chamber insulator, the cathode connector tube also being disposed within and forming an annular cooling liquid outlet chamber with the hollow interior of the cathode insulator connector, the cathode connector tube having a hollow interior and having apertures therein spaced around the annular cooling liquid outlet chamber, the cathode insulator connector having a passage therein connecting the annular cooling liquid chamber to a location at the outside of the cathode insulator connector;

a cathode tip coupled to an end of the cathode connector tube and disposed within the hollow interior of the chamber insulator;

an inner connector tube having a hollow interior and mounted within the hollow interior of the cathode connector tube and forming a cooling liquid return passage with the hollow interior of the cathode connector tube including the apertures within the cathode connector tube spaced around the annular cooling liquid outlet chamber; and a fitting coupled to an end of the inner connector tube and communicating with the hollow interior thereof so that cooling liquid may be supplied via the fitting to the hollow interior of the inner connector tube.

15. The invention set forth in claim 14, wherein the cathode connector tube has an axis of elongation and includes an annular collar extending across the gas passage between the chamber insulator and the gas conductor tube and having a plurality of apertures therethrough spaced around the collar and being oriented at oblique angles relative to the axis of elongation to force gas passing therethrough into a swirling pattern.

16. A cathode assembly comprising the combination of:

a generally cylindrical housing having a hollow interior;

an elongated, generally cylindrical connector tube member having an axis of elongation, the connector tube member being disposed within and forming an annular space with the hollow interior of the housing;

a cathode tip coupled to an end of the connector tube member within the hollow interior of the housing;

an annular gas chamber within the housing communicating with the annular space and adapted to receive a supply of pressurized, substantially inert gas; and an annular collar disposed within the annular space between the gas chamber and the cathode tip, the annular collar having a plurality of apertures therethrough spaced about the annular collar and being at oblique angles relative to the axis of elongation of the connector tube member.

17. The invention set forth in claim 16, wherein the housing includes a cylindrical wall disposed between the annular gas chamber and the annular space, the cylindrical wall having a plurality of apertures therethrough spaced around the annular collar to admit gas from the annular collar into the annular space.

18. The invention set forth in claim 16, wherein the annular space has a first portion of first, generally uniform diameter extending from the annular collar and a second portion of second, generally uniform diameter smaller than the first diameter, the second portion extending from a juncture thereof with the first portion to the cathode tip, and the annular collar is located adjacent the juncture of the second portion with the first portion of the annular space.

19. A cathode assembly comprising the combination of:

a generally cylindrical housing having a hollow interior;

an elongated, generally cylindrical connector tube member having a hollow interior extending from a first end thereof along most of the length of the connector tube member between the first end and an opposite second end thereof, the connector tube member being disposed within the hollow interior of the housing;

a cathode tip coupled to the second end of the connector tube member;

means for introducing pressurized, substantially inert gas to an exterior of the connector tube member and the cathode tip;

an elongated cooling tube member having a hollow interior and disposed within the hollow interior of the connector tube member to form a space between an exterior thereof and the hollow interior of the connector tube member; and means for introducing a cooling liquid to the hollow interior of the cooling tube member, whereby the cooling liquid flows along the hollow interior of the cooling tube member, out an open end thereof, and through the space between the exterior of the cooling tube member and the hollow interior of the connector tube member.

20. The invention set forth in claim 19, wherein the means for introducing a cooling liquid includes a conduit fitting coupled to communicate with the hollow interior of the cooling tube member to introduce cooling liquid into the hollow interior of the cooling tube member, and the housing includes means for coupling the space between the exterior of the cooling tube member and the hollow interior of the connector tube member to an exterior location on the housing.

21. The invention set forth in claim 20, wherein the means for coupling the space between the exterior of the cooling tube member and the hollow interior of the connector tube member to an exterior location on the housing includes an annular cooling liquid outlet chamber within the housing surrounding a portion of the connector tube member and communicating through the connector tube member to the space via a plurality of apertures in the connector tube member, and an aperture in the housing extending between the annular cooling exit chamber and the exterior location on the housing.

22. A plasma gun for generation of a supersonic plasma stream comprising the combination of:

a body;

a plurality of electrodes of like polarity mounted in the body; and a common electrode of polarity opposite the like polarity of the plurality of electrodes mounted within the body and having a central mixing chamber therein defining a sonic region of the plasma gun, a plurality of arc chambers therein, each receiving a different one of the plurality of electrodes of like polarity and extending into the central mixing chamber, and a nozzle chamber extending in diverging fashion from the central mixing chamber to an exterior of the body and defining a supersonic region of the plasma gun.

23. The invention set forth in claim 22, wherein the common electrode has a central powder delivery aperture therein extending to a portion of the central mixing chamber opposite the nozzle chamber.

24. A plasma gun comprising the combination of:

an anode assembly having a central axis and including a central mixing chamber of generally cylindrical configuration therein disposed along the central axis and defining a sonic region of the plasma gun, a central nozzle chamber of generally partially conical configuration therein disposed along the central axis and extending from the central mixing chamber to an exterior of the anode assembly and defining a supersonic region of the plasma gun, and a plurality of arc chambers therein extending from portions of the central mixing chamber opposite the nozzle chamber, the plurality of arc chambers being generally equally spaced around the central axis; and a plurality of cathodes, each disposed within a different one of the plurality of arc chambers.

25. The invention set forth in claim 24, wherein each of the plurality of arc chambers is comprised of a generally cylindrical portion terminating at the central mixing chamber and a generally partially conical portion extending in diverging fashion from an end of the generally cylindrical portion opposite the mixing chamber and receiving one of the cathodes therein.

26. The invention set forth in claim 24, wherein each of the arc chambers has a central axis which intersects the central axis of the anode assembly within the central mixing chamber.

27. The invention set forth in claim 24, wherein the anode assembly includes a material delivery aperture therein disposed along the central axis and terminating at a portion of the central mixing chamber opposite the nozzle chamber.

28. A plasma gun comprising the combination of:

a gun body;

a plurality of electrodes of like polarity mounted in the gun body;

a common electrode of polarity opposite the like polarity of the plurality of electrodes mounted within the gun body and including an electrode body having a central axis, a central chamber therein disposed along the central axis, a plurality of arc chambers therein spaced around the central axis and each receiving a different one of the plurality of electrodes of like polarity and extending into the central chamber, and a material delivery aperture therein extending along the central axis and terminating at the central chamber; and a material delivery element removably mounted within the material delivery aperture and having at least one port therein for delivery of spray material to the central chamber, the at least one port being disposed along the central axis and terminating at the central chamber.

29. The invention set forth in claim 28, wherein the at least one port comprises a plurality of ports in the material delivery element, each terminating at a different one of the plurality of arc chambers.

30. A plasma gun comprising the combination of:

an anode body having a central axis, a central mixing chamber therein disposed at the central axis and having opposite first and second ends thereof, a central nozzle chamber therein disposed along the central axis and extending from the second end of the central mixing chamber to an exterior of the anode body, an aperture therein disposed along the central axis and extending from the first end of the central mixing chamber, and a plurality of arc chambers therein extending from portions of the central mixing chamber adjacent the first end of the central mixing chamber;

a plurality of cathodes, each disposed within a different one of the plurality of arc chambers; and a material delivery element removably mounted within the aperture in the anode body and having at least one port therein for delivery of spray material to the central mixing chamber, the material delivery element comprising a generally cylindrical powder insert having at least one material delivery port therein.

31. The invention set forth in claim 22, wherein the powder insert has a single powder delivery port disposed along the central axis and terminating at the central mixing chamber.

32. The invention set forth in claim 30, wherein the powder insert has a plurality of powder delivery ports therein, each terminating at a different one of the plurality of arc chambers.

33. The invention set forth in claim 32, wherein the powder insert has a central bore therein and each of the powder delivery ports extends from the central bore at an acute angle relative to the central axis of the anode body.

34. The invention set forth in claim 32, wherein the powder insert has a central bore therein and each of the powder delivery ports extends from the central bore generally parallel to and spaced-apart from the central axis of the anode body.

35. A plasma gun comprising the combination of:

a plurality of electrodes of like polarity; and a common electrode of polarity opposite the like polarity of the plurality of electrodes and having a central chamber therein, a plurality of arc chambers therein each receiving a different one of the plurality of electrodes of like polarity therein and extending into the central chamber, and a plurality of material delivery ports each of which extends into a different one of the arc chambers adjacent the central chamber.

36. The invention set forth in claim 35, further including means for delivering powder material to the material delivery ports.

37. The invention set forth in claim 35, wherein the plurality of material delivery ports are contained within a powder insert which is removably mounted in the common electrode.

38. A plasma gun comprising the combination of:

an anode assembly having a central axis and including a central mixing chamber therein disposed at the central axis and having opposite first and second ends thereof, a central nozzle chamber disposed along the central axis and extending from the second end of the central mixing chamber to an exterior of the anode assembly, a plurality of arc chambers therein extending from portions of the central mixing chamber adjacent the first end thereof and being generally equally spaced around the central axis, a central material delivery port disposed at the central axis adjacent the first end of the central mixing chamber, and a plurality of branch material delivery ports, each extending from the central material delivery port to a different one of the arc chambers adjacent the central mixing chamber; and a plurality of cathodes, each disposed within a different one of the plurality of arc chambers.

39. The invention set forth in claim 38, wherein the central material delivery port and the plurality of branch material delivery ports are contained within a generally cylindrical powder insert removably mounted within the anode assembly.

40. A plasma gun assembly comprising the combination of:

a gun body;

an electrode mounted within the gun body and having an annular cavity therein surrounding a base thereof, a central plasma chamber extending into the electrode from the base, at least one arc chamber within the electrode extending from the central plasma chamber and a plurality of passages extending through the electrode from the annular cavity;

means for conveying cooling fluid from outside the gun body to a region adjacent the base of the electrode;

means defining a plurality of angled apertures adjacent the base of the electrode, the angled apertures introducing cooling fluid into the annular cavity with a swirling motion; and means coupled to the plurality of passages extending through the electrode for conveying cooling fluid passing through the plurality of passages from the annular cavity to the outside of the gun body.

41. The invention set forth in claim 40, wherein the plasma gun assembly includes an electrode retainer plate fastened to the gun body at the base of the electrode to secure the electrode within the gun body, the electrode retainer plate having a circular array of angled slots therein disposed between the region adjacent the base of the electrode and the annular cavity, the angled slots together with an adjacent portion of the gun body defining the plurality of angled apertures.

42. The invention set forth in claim 40, further including a material delivery structure coupled to the electrode at a top end of the electrode opposite the base and communicating with the arc chamber within the electrode and an insert clamp structure coupled to the top end of the electrode and forming an annular passage between the insert clamp structure and the material delivery structure, the insert clamp structure having lower and upper hollow, generally cylindrical portions thereof having arrays of apertures therein, the lower hollow, generally cylindrical portion introducing cooling fluid passing through the plurality of apertures from the annular cavity into the annular passage between the insert clamp structure and the material delivery structure with a swirling motion and the upper hollow, generally cylindrical portion introducing cooling fluid in the annular passage between the insert clamp structure and the material delivery structure into a further portion of the material delivery structure.

43. A plasma gun assembly comprising the combination of:

a generally cylindrical gun body having a top with an annular cavity therein, an opposite bottom, a generally cylindrical bore therein extending along a central axis of the gun body between the top and the bottom and a plurality of apertures extending through the gun body from the annular cavity in the top to the bottom;

an anode assembly mounted within a portion of the bore of the gun body adjacent the bottom of the gun body;

material delivery apparatus mounted within the bore of the gun body between the anode assembly and the top of the gun body;

a generally disk-shaped top plate coupled to the top of the gun body and having at least one cooling liquid inlet fitting mounted thereon and communicating with the annular cavity in the top of the gun body and at least one cooling liquid outlet fitting mounted thereon and communicating with the bore at the top of the gun body; and a generally disk-shaped bottom plate coupled to the bottom of the gun body and having an annular cavity therein communicating with the plurality of apertures extending through the gun body and with the anode assembly.

44. The invention set forth in claim 43, wherein the bottom plate has a circular flange thereon at an inner portion of the annular cavity therein, the circular flange having a plurality of angled slots therein to provide cooling liquid flowing from the annular cavity to the anode assembly with a swirling motion.

45. The invention set forth in claim 44, wherein the anode assembly has an annular cavity therein surrounding a base thereof adjacent the annular flange of the bottom plate and a plurality of passages extending therethrough between the annular cavity surrounding the base thereof and a top of the anode assembly opposite thereof.

46. The invention set forth in claim 45, wherein the material delivery apparatus includes a powder insert holder disposed along a portion of the central axis of the gun body and extending into the top of the anode assembly, and further including an insert clamp coupled to the top of the anode assembly and having a portion of hollow, generally cylindrical configuration surrounding and spaced-apart from the powder insert holder to form an annular passage therebetween, the portion of hollow, generally cylindrical configuration of the insert clamp having angled apertures in a lower portion thereof to produce swirling motion in cooling liquid passing therethrough into the annular passage and apertures in an upper portion thereof through which cooling liquid passes as it leaves the annular passage.

47. The invention set forth in claim 46, wherein the material delivery apparatus includes an anode connector plug of generally cylindrical configuration extending between the insert clamp and the top plate and forming an annular passage with the wall of the bore of the gun body between a lower flange thereof which extends into contact with the wall of the bore and the top plate, the lower flange having a plurality of radial slots therein to pass cooling liquid from the upper portion of the insert clamp to the annular passage between the anode connector plug and the wall of the bore.

48. A plasma gun assembly comprising the combination of:

a gun body;

an anode assembly mounted within the gun body and having a central axis;

a plurality of cathode assemblies mounted within the gun body and disposed about the central axis of the anode assembly;

a material delivery insert structure extending into the anode assembly along the central axis;

an insert clamp structure mounted on the anode assembly and coupled to the material delivery insert structure, the insert clamp structure surrounding and forming a passage with the material delivery insert structure; and means introducing cooling liquid at the insert clamp structure, the insert clamp structure being operative to convey cooling liquid introduced thereat into the passage and over a substantial portion of the material delivery insert structure.

49. The invention set forth in claim 48, wherein the means for introducing cooling liquid at the insert clamp structure includes means for introducing cooling liquid at a base of the anode assembly and a plurality of passages extending through the anode assembly from the base thereof to an opposite top end of the anode assembly adjacent the insert clamp structure.

50. The invention set forth in claim 48, wherein the insert clamp structure has a lower hollow, generally cylindrical portion thereof having a plurality of angled apertures therein to convey cooling liquid into the passage with a swirling motion.

51. The invention set forth in claim 50, wherein the insert clamp structure is coupled to the material delivery insert structure at an upper end of the passage and has an upper hollow, generally cylindrical portion adjacent the upper end of the passage and having a plurality of apertures therein through which cooling liquid in the passage exits.

52. A plasma gun comprising the combination of:

a body;

a plurality of electrodes of like polarity mounted in the body;

a common electrode of polarity opposite the like polarity mounted within the body, the common electrode interacting with the plurality of electrodes of like polarity to produce a plasma stream; and means coupled to the common electrode for introducing metal in a molten state into the plasma stream, the common electrode having a plurality of arc chambers therein receiving the plurality of electrodes of like polarity and a central chamber therein communicating with the plurality of arc chambers and forming the plasma stream therein, and the means for introducing metal in a molten state including a hollow feed tube extending into the common electrode and communicating with the central chamber therein and means for introducing metal in a molten state into the hollow feed tube.

53. The invention set forth in claim 52, wherein the means for introducing metal in a molten state into the hollow feed tube includes a hollow supply tube coupled to the hollow feed tube and adapted to receive metal therein in solid form and a power supply coupled to the supply tube to heat metal therein to a molten state.

54. The invention set forth in claim 53, wherein the means for introducing metal in a molten state into the hollow feed tube includes a melt bowl disposed between the feed tube and the supply tube and a supply of pressurized gas selectively coupled to an opposite portion of the supply tube from the melt bowl, the melt bowl being operative to block the flow of metal in a molten state from the supply tube to the feed tube in response to gas pressure in the central chamber of the common electrode except when the supply of pressurized gas is coupled to the opposite portion of the supply tube.

55. The invention set forth in claim 1, wherein each of the plurality of electrodes of a first polarity includes an electrode tip extending into the annular chamber, and the means for injecting injects an inert gas over the electrode tip and into the annular chamber in a swirling pattern.

56. The invention set forth in claim 55, wherein the electrode tip has an axis of elongation, and the means for injecting directs inert gas through a plurality of apertures spaced about the electrode tip and forming oblique angles relative to the axis of elongation of the electrode tip.

57. The invention set forth in claim 6, wherein each of the cathodes has a cathode tip, and the means for providing provides the flow of substantially inert gas in a swirling pattern over the cathode tip.

58. The invention set forth in claim 57, wherein the cathode tip has an axis of elongation, and the means for providing includes means for directing inert gas through a plurality of apertures spaced above the cathode tip and forming oblique angles relative to the axis of elongation of the cathode tip.

59. A plasma system comprising the combination of:

a plasma gun positioned in operative relation to a workpiece and having a common, centrally positioned anode, a plurality of cathodes spaced above the anode and each having a tip, each of the cathodes being positioned in plasma arc forming relation with the anode in response to the flow of substantially inert gas at the cathode, the anode having a central mixing chamber and a plurality of arc chambers therein, each of the arc chambers receiving the tip of a different one of the plurality of cathodes and having a length extending from a region surrounding the tip to a downstream end thereof at the central mixing chamber, power supply means coupling the anode to each of the plurality of cathodes and producing an arc comprised of an ion flow extending from the tip of each cathode within the arc chamber receiving the tip, the length of each arc chamber being of sufficient size to contain essentially of the ion flow of the arc, with the central mixing chamber defining an essentially electrically neutral region downstream of the arc chambers;

an enclosure surrounding the plasma gun and the workpiece; and a vacuum source coupled to the enclosure to provide an ambient pressure of 0.6–0.001 atmospheres within the enclosure.

60. The invention set forth in claim 59, further including spray power injection means extending into the central mixing chamber from a location intermediate the arc chambers.

* * * * *